US005687507A

United States Patent [19]

Beran

[11] Patent Number: 5,687,507

[45] Date of Patent: Nov. 18, 1997

[54] APPARATUS FOR SELECTIVE ALTERATION OF OPERATING PARAMETERS OF A DOOR

[75] Inventor: Mark A. Beran, Niwot, Colo.

[73] Assignee: Dorma Door Controls Inc., Reamstown, Pa.

[21] Appl. No.: 537,035

[22] Filed: Sep. 29, 1995

Related U.S. Application Data

[63] Continuation of Ser. No. 92,962, Jul. 19, 1993, abandoned.

[51] Int. Cl.[6] ..... E05F 11/24

[52] U.S. Cl. ..... 49/340; 74/89.15; 49/339

[58] Field of Search ..... 49/32, 334, 340, 49/341, 339; 16/52, 58, 62; 74/89.15, 89.17

[56] References Cited

U.S. PATENT DOCUMENTS

| | | | |
|---|---|---|---|
| 1,684,704 | 9/1928 | Hubbell . | |
| 2,256,613 | 9/1941 | Forman et al. . | |
| 3,127,160 | 3/1964 | Wallmann . | |
| 3,129,936 | 4/1964 | Carlson . | |
| 3,874,117 | 4/1975 | Boehm . | |
| 4,040,144 | 8/1977 | Lasier et al. | 49/32 X |
| 4,220,051 | 9/1980 | Catlett | 74/89.15 |
| 4,222,147 | 9/1980 | Burnett, Jr. . | |
| 4,339,848 | 7/1982 | Burnett, Jr. . | |
| 4,348,835 | 9/1982 | Jones et al. . | |
| 4,429,490 | 2/1984 | Zunkel . | |
| 4,727,679 | 3/1988 | Kornbrekke et al. . | |
| 4,793,023 | 12/1988 | Simpson et al. . | |
| 4,952,080 | 8/1990 | Boiucaner et al. . | |
| 4,995,194 | 2/1991 | Schultze et al. . | |

FOREIGN PATENT DOCUMENTS

| | | | |
|---|---|---|---|
| 0632181 | 1/1995 | European Pat. Off. . | |
| 3730114 | 5/1988 | Germany . | |
| 4124282 | 1/1993 | Germany . | |
| 4323150 | 1/1995 | Germany . | |
| 475073 | 11/1937 | United Kingdom | 49/32 |
| 8911578 | 11/1989 | WIPO . | |

*Primary Examiner*—Jerry Redman

[57] ABSTRACT

Apparatus is are disclosed for selective alteration and control of door movement modes, the apparatus being primarily non-hydraulic and incorporated with a known mechanism which is functional independently from the apparatus in one mode of operation and which includes a piston for controlling door closing characteristics by selected fluid flow within the mechanism. The apparatus includes a motor driven lead screw having a linearly movable shuttle unit mounted thereon, the shuttle unit being positioned relative to the piston of the mechanism to accommodate nonattached contact with the piston to urge the piston, when the shuttle unit is moved, in a direction that will at least provide selective assistance with door opening in another mode of operation.

16 Claims, 22 Drawing Sheets

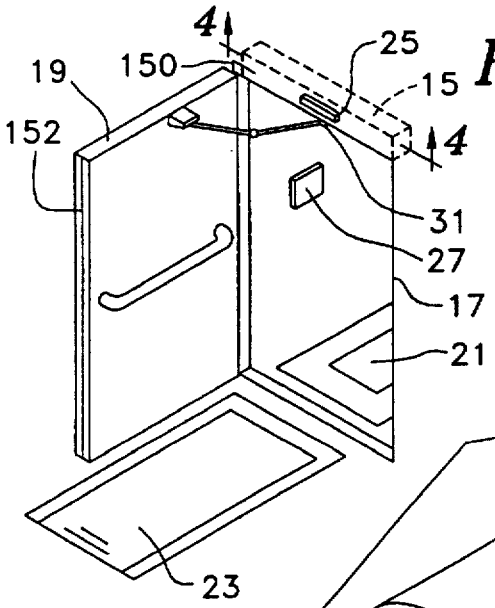
FIG. 1
FIG. 3
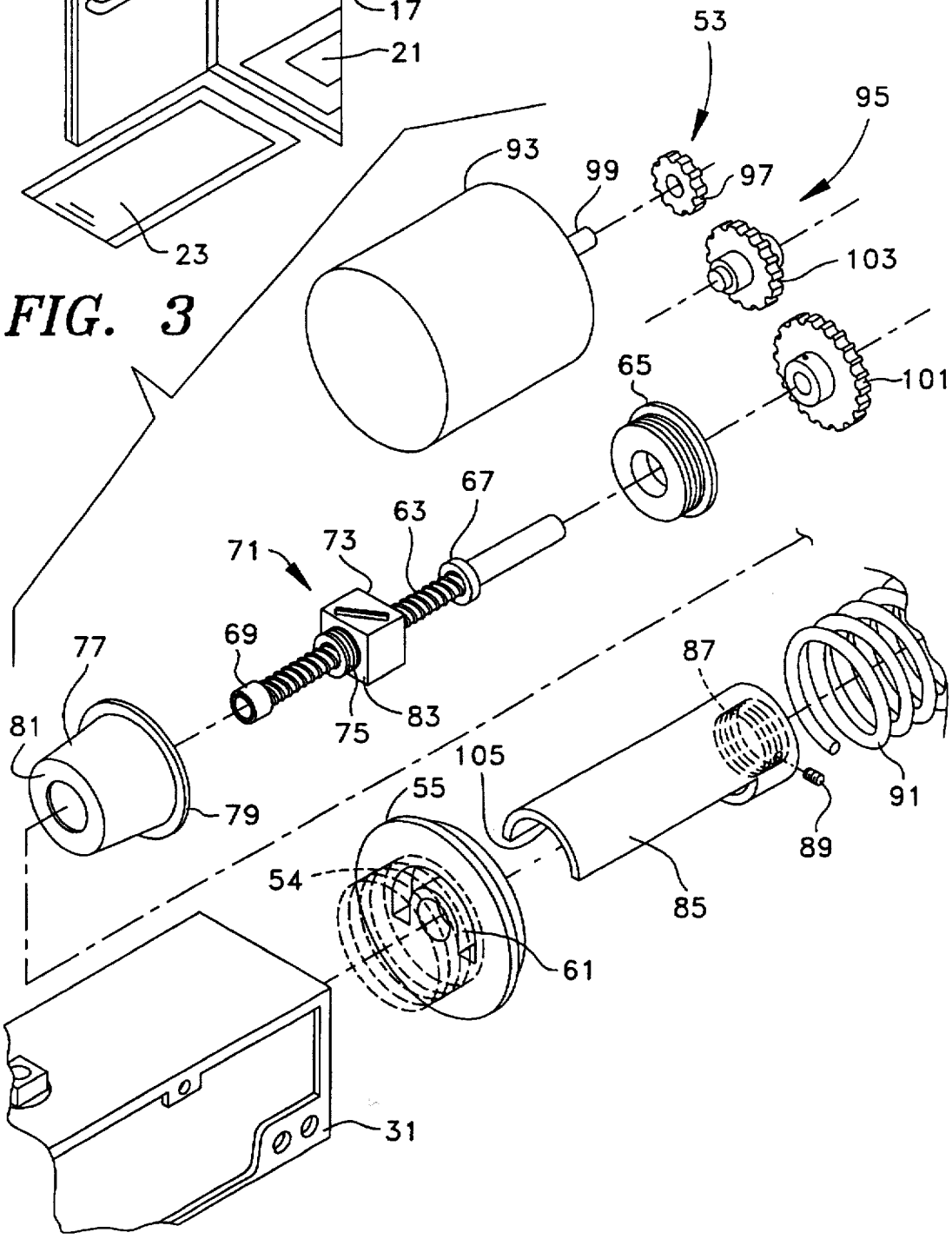

| FIG.8B | FIG.8C |
|---|---|
| FIG.8D | FIG.8E |

| FIG.9A | FIG.9B | FIG.9C |
|---|---|---|
| FIG.9D | FIG.9E | |

MTP50N05E
+15V
1K
R25
D8
1N4148
D9
1N4148
Q1
2N3804
R23
10K
U3.A
RESET
+5V
C18
1μ
R3
1M
D3
1N4148
U4.D
74HC04
R2
1M
+5V+5V
1N4148
D2
C17
100n
KICK
125
U7
74HC85
A<Bi
A=Bi
A<Bo
A=Bo
PD0
PD1
PD2
PD3
PD(0..7)
6MHz
3MHz
1.5MHz
750KHz
U5
74HC163
EP
ET
LD
P0
P1
P2
P3
Q0
Q1
Q2
Q3
RC
RST
12MHz
PWMEN
ELEC
C13
10μ
25V
U2
LM78L05
IN
OUT
GRD
114
U6
U4.B
U4.F
U4.C
U4.E
U9.B
LM358
C1
C2
C3
C4
C5
C6
C7
C8
C9
100n
U1
U2
U3
U4
U5
U6
U7
U8
U9

$$\text{MOTOR ANGULAR VELOCITY} = \frac{\text{DOOR ANGULAR VELOCITY} \times \text{GEAR RATIO}}{\text{GAMMA FUNCTION}}$$

$$\text{DOOR ANGULAR VELOCITY} = \frac{\text{MOTOR ANGULAR VELOCITY} \times \text{GAMMA FUNCTION}}{\text{GEAR RATIO}}$$

$$\text{GAMMA INTEGRAL} = \int \text{GAMMA FUNCTION } de$$

$$\text{DOOR ANGLE} = \frac{\text{MOTOR ANGLE} \times \text{GAMMA INTEGRAL}}{\text{GEAR RATIO}}$$

$$\text{MOTOR ANGLE} = \frac{\text{DOOR ANGLE} \times \text{GEAR RATIO}}{\text{GAMMA INTEGRAL}}$$

$$\text{DOOR'S EDGE FORCE} = \frac{\text{MOTOR TORQUE} \times \text{GEAR RATIO}}{\text{DOOR WIDTH} \times \text{GAMMA FUNCTION}}$$

$$\text{MOTOR TORQUE} = \frac{\text{DOOR'S EDGE FORCE} \times \text{DOOR WIDTH} \times \text{GAMMA FUNCTION}}{\text{DOOR WIDTH} \times \text{GAMMA FUNCTION}}$$

POWER UP

A
LATCH STATE
1st LEARN STATE
PISTON FOUND ?
N
Y
2nd LEARN STATE
3rd LEARN STATE
MUST OPEN ?
4th LEARN STATE
MUST OPEN ?
B
AT LATCH
MUST OPEN ?
@ LATCH ?
STRIKE PLATE ?
DRIVE STRIKE PLATE
FULL AUTO ?
POWER ASSIST ?
MUST CLOSE ?
FULL AUTO ?
@ LATCH ?
@ LATCH ?
POWER ASSIST ?
H
J
K
L
M
P

APPARATUS FOR SELECTIVE ALTERATION OF OPERATING PARAMETERS OF A DOOR

RELATED APPLICATION

This Application is a continuation of now U.S. patent application Ser. No. 08/092,962 filed Jul. 19, 1993, now abandoned by Mark A. Beran and entitled "Apparatus and Method for Selective Alteration of Operating Parameters of a Door".

FIELD OF THE INVENTION

This invention relates to apparatus and methods for controlling the operation of doors, and, more particularly, relates to door opening and closing apparatus and methods.

BACKGROUND OF THE INVENTION

Hydraulic and/or pneumatic door closers for controlling closing characteristics of swing doors are well known and have been in wide use (see, for example, U.S. Pat. Nos. 4,793,023, 4,414,703 and 4,378,612). Primarily hydraulically or pneumatically operated openers and/or opening assist mechanisms are also known (see U.S. Pat. Nos. 3,948,000, 3,936,977, 4,995,194 and 4,429,490). Similarly, a variety of electromechanical automatic door operators have been heretofore known and/or utilized (see U.S. Pat. Nos. 2,910,290, 3,127,160, 4,045,914 and 4,220,051). Each (hydraulic and/or pneumatic and electromechanical operators) has its own unique advantages and disadvantages.

There has also been some attempt at combining these approaches so that at least some of the advantages of each are utilized (see, for example, U.S. Pat. Nos. 3,874,117, 3,129,936, 1,684,704, 2,256,613, and 4,438,835). Such approaches to door controllers have for the most part sought to utilize the hydraulic mechanism merely as a speed control (i.e., not as an independently functioning unit), and/or have utilized each type of operator in parallel connection with the door rather than in conjunction. Such approaches are not entirely satisfactory due to lack of attractiveness and additional space requirements adjacent to the door, expense of manufacture and/or operation (for example, where a clutch or other disengagement mechanism is required for operation, or where a motor is in constant operation for causing both opening and active door closing), and/or undue control complexity required to achieve reliability and to meet door operating standards.

In view of recent concern and legislation regarding provision of access for the disabled to various public and private buildings, it would be desirable to provide a low cost, low power and reliable apparatus for use with a standard, typically hydraulically dampening, door closer arrangement to provide a door operator which meets the accessibility requirements of the disabled while preserving the functionality and meeting compliance requirements of the standard door closer.

Typical compliance requirements, such as those established in the A.N.S.I. guidelines, include minimum efficiency standards for door closers. In U.S. Pat. No. 4,995,194, wherein a hydraulic pump is utilized to move fluid, and thus a piston, to assist with door opening, door closing efficiency is maintained by using the same hydraulic flow path or paths for closing as has been traditionally used by such door closers. In this manner (utilizing no additional components directly connected to the existing piston) no additional drag is placed on the system and thus the efficiency is unchanged. In order to meet efficiency requirements while using an electromechanical drive to open the door, either carefully controlled motor driven opening and closing or various clutching mechanisms for decoupling an electromechanical drive during the closing cycle (particularly necessary in the event of an interruption of power supply) have generally been required.

Improvement of door operators directed to maintaining and/or enhancing the utility and efficiency of traditionally utilized hydraulic or pneumatic door closers, while selectively providing low power yet fully automatic door opening and/or opening assistance, without undue complication and expense, could thus be utilized.

SUMMARY OF THE INVENTION

This invention provides apparatus for selective alteration of the operating parameters of a swing door, the apparatus being utilized with, or incorporating, a known type of mechanism connectable with a door and including a piston for controlling door closing characteristics by selected fluid flow within the mechanism. The apparatus is configured for maintaining and/or enhancing the utility and efficiency of the closing control mechanism without undue complication, while selectively providing low power yet fully automatic door opening and/or opening assistance, and is simple to install (i.e., can be mounted for left or right mounted doors on either the push or pull side of the door without need for special parts or modifications) and operate.

The apparatus selectively operates in plural modes and can thus be utilized to provide entranceway accessibility to handicapped or disabled persons in compliance with requirements of various legislation, while at the same time allowing a wide range of user adjustable door closing forces. The power opening assist mode of the apparatus (selected, for example, by user activation of a push plate or the like) reduces required opening force applied by a user to between 0.5 to 5 lbs. Both the power assist mode and the automatic opening mode of operation of the apparatus meets A.N.S.I. guidelines (A 156.19-1990) for low energy automatic and power assist door operators.

In the normal mode of operation the apparatus functions as a typical manual door closer (i.e., user push open with hydraulic/spring closing characteristics, for example, under the control of the closer mechanism), meeting the requirements of a grade 1 door closer as delineated in A.N.S.I. guidelines (A156.4-1991).

The apparatus is primarily non-hydraulic and selectively directly manipulates the piston of the mechanism. A movable element is positioned to accommodate nonattached contact with the piston of the mechanism for urging the piston in one direction when the element is moved by a selectively operable actuator. The piston of the mechanism remains normally movable in the one direction by a user opening the door in a first door operating mode and is selectively urged in the one direction by movement of the element to at least provide selective assistance with door opening in a second door operating mode.

It is therefore an object of this invention to provide an improved swing door operating apparatus.

It is another object of this invention to provide improved apparatus for selective alteration of the operating parameters of a swing door.

It is still another object of this invention to provide an improved apparatus for swing door operation that is utilized with, or incorporates, a known type of mechanism connectable with a door and which includes a piston for controlling door closing characteristics by selected fluid flow within the mechanism.

It is still another object of this invention to provide an apparatus configured for maintaining and/or enhancing the utility and efficiency of known types of door closing control mechanisms, while, without undue complication, selectively providing low power yet fully automatic door opening and/or opening assistance.

It is yet another object of this invention to provide a door operations control apparatus that can be used for entranceways accessible to handicapped or disabled persons in compliance with requirements of various legislation, that has a selectively actuated power assist mode of operation which reduces the required opening force to from 0.5 to 5 lbs., that has a selectively actuated automatic opening mode meeting A.N.S.I. guidelines for low energy automatic and power assist door operators, and that in a normal mode of operation functions as a typical manual door closer meeting the requirements of a grade 1 door closer as delineated in A.N.S.I. guidelines.

It is still another object of this invention to provide a manipulating apparatus for use in association with a mechanism connectable with a door and including a piston for controlling door closing characteristics by selected fluid flow within the mechanism, wherein the apparatus is primarily non-hydraulic and engageable adjacent to the mechanism for selective direct manipulation of the piston of the mechanism to at least selectively assist with door opening.

It is yet another object of this invention to provide an apparatus for selectively altering operating parameters of a door which is configured for use in association with an independently functional mechanism connectable with a door and including a piston normally substantially freely movable in one direction by a user opening the door and movable in another direction for controlling door closing characteristics by selected fluid flow within the mechanism, the apparatus including a movable element positioned to accommodate nonattached contact with the piston of the mechanism for urging the piston in the one direction when the element is moved, and an actuator selectively operable for causing movement of the element, wherein the piston of the mechanism remains normally movable in the one direction by a user opening the door in a first door operating mode and is selectively urged in the one direction by movement of the element of the apparatus to at least provide selective assistance with door opening in a second door operating mode.

With these and other objects in view, which will become apparent to one skilled in the art as the description proceeds, this invention resides in the novel construction, combination, and arrangement of parts substantially as hereinafter described, and more particularly defined by the appended claims, it being understood that changes in the precise embodiment of the herein disclosed invention are meant to be included as come within the scope of the claims.

BRIEF DESCRIPTION OF THE DRAWINGS

The accompanying drawings illustrate a complete embodiment of the invention according to the best mode so far devised for the practical application of the principles thereof, and in which:

FIG. 1 is a perspective view of the apparatus of this invention in position in a doorway;

FIG. 3 is a partial exploded view of the apparatus of this invention;

DESCRIPTION OF THE INVENTION

Figure 2:
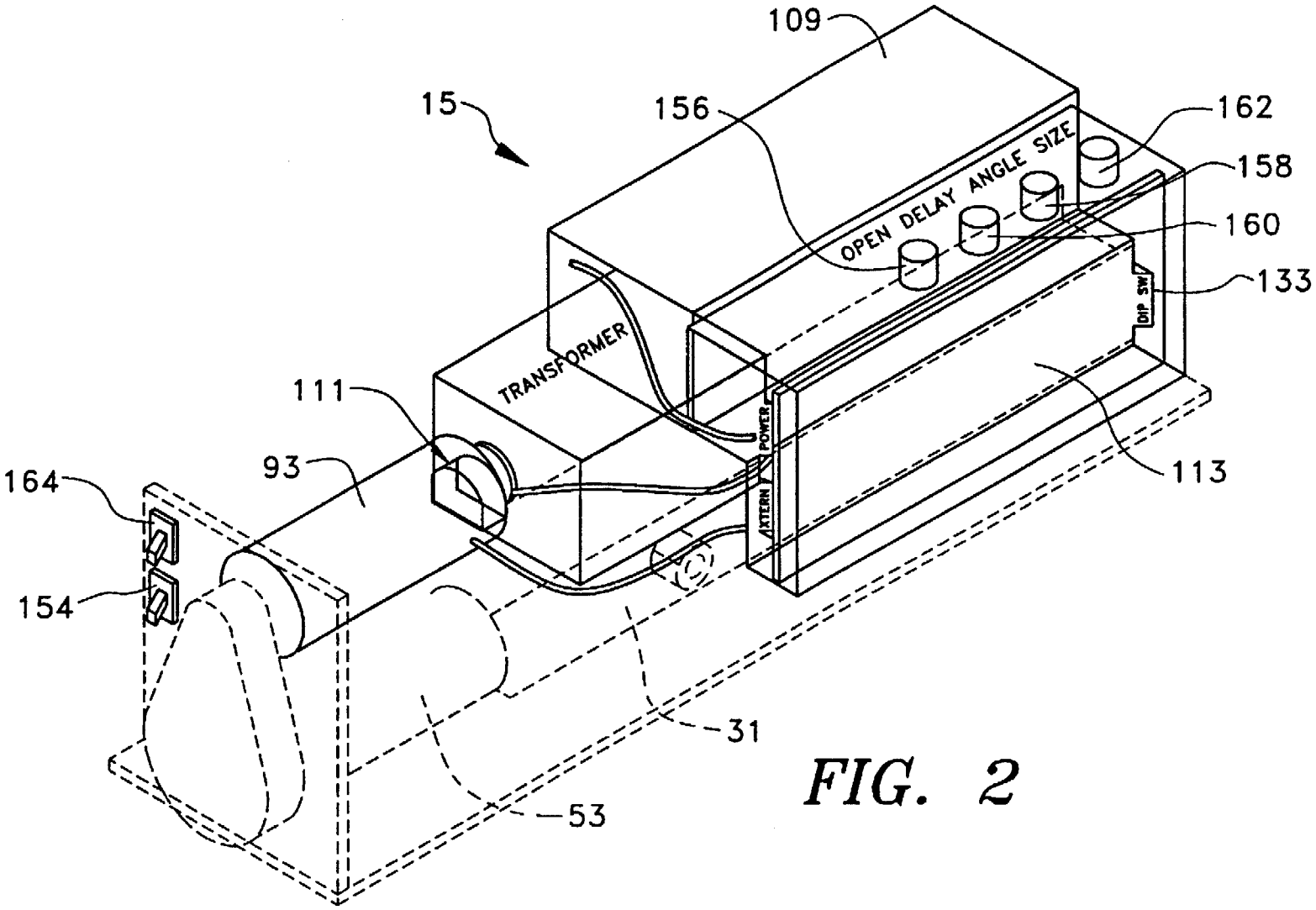
FIG. 2 is a partial perspective view of the apparatus of this invention.
Figure 4:
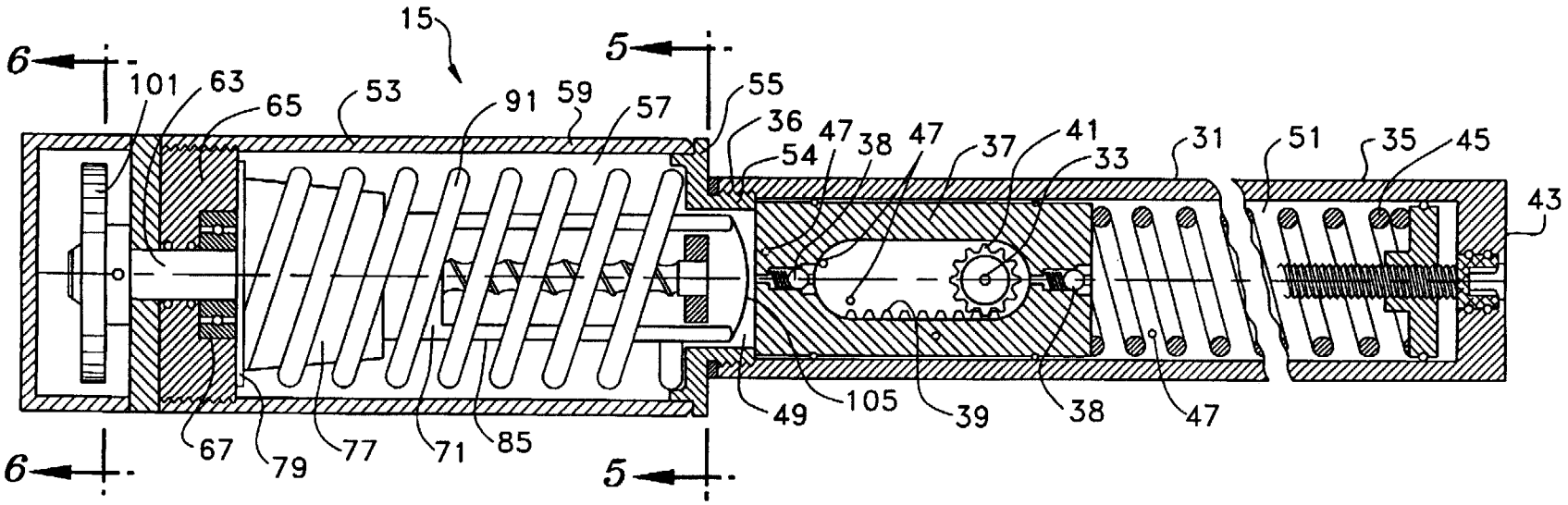
FIG. 4 is a partial sectional view taken through section lines 4—4 of FIG. 1.

FIG. 1 shows apparatus 15 of this invention mounted in doorway 17 adjacent to door 19. For purposes of illustration only, various movement sensors and actuators are illustrated, such as pressure pads 21 and 23, infrared (IR) or radio frequency (RF) sensor 25, and push plate 27, which may be utilized for actuation of apparatus 15 as discussed hereinbelow.

As also shown in FIGS. 2 through 4 and 7, apparatus 15 includes, or is retrofittable with, standard door closing speed control mechanism 31 including, in the case illustrated in FIG. 2 for a push side mounting (i.e., push open) of the mechanism to the door, a two-piece relatively pivotable control arm 32 pivotably connected at shaft 33 at one end and at door 19 at the other end. Apparatus 15 is adaptable as well to pull open type doors having a control arm connected with mechanism 31 at one end and at the other end to a slide track mounted on the door face, as is well known to those skilled in the art.

While devices such as mechanism 31 are well known to those skilled in the art (see, for example, U.S. Pat. No. 4,793,023, for a variation on the commonly known speed control mechanism), mechanism 31 typically will include cylinder 35 (most often with a threaded access passage 36 at one or both ends for maintenance, repair and the like) having shaft 33 rotatably journalled therethrough and piston 37 (having check valves 38 therein to allow free passage of fluid therethrough during the opening cycle of door 19) mounted for reciprocal movement in cylinder 35. Piston 37 has shaft 33 passing therethrough and rack 39 defined at one interior side thereof. Pinion gear 41 is mounted on shaft 33 so that, when door 19 is opened, shaft 33 and thus pinion gear 41 are rotated thereby moving piston 37 toward end 43 by their engagement with rack 39. In this manner, return spring 45 is loaded, closing characteristics of the door (for example, sweep and latch) thus being controlled by a combination of the unloading of spring 45 and controlled passage of oil in cylinder 35 through the various fluid passageways 47 between variable volume compartments 49 and 51.

Apparatus 15 includes substantially non-hydraulic, electromechanical operator unit 53 engageable with mechanism 31 at threaded end portion 54 of housing end plate 55 in opening 36 of mechanism 31 thus allowing operational communication between chamber 57 of housing 59 and compartment 49 of mechanism 31 through opening 61 in end plate 55 (see FIGS. 2 through 5). Unit 53 includes lead screw 63 rotatably supported in end plates 65 and 55 by bearings 67 and 69, respectively, (see FIG. 7). Shuttle assembly 71 is mounted on screw 63 and is linearly movable therealong.

Shuttle assembly 71 includes lead screw nut 73 (for example, a ball nut assembly) which has a threaded male projection 75 at one side thereof. Spring retainer cup 77 having retaining lips 79 and 81 is mounted over screw 63 with lip 81 abutting surface 83 of nut 73. Shuttle 85 having threaded opening 87 is threaded onto projection 75 of nut 73, and is held in place thereon by set screw 89. Return spring 91 is mounted between end plate 55 and lip 79 of retainer cup 77, and is thus loaded when shuttle assembly 71 is moved toward and through end plate 55 upon rotation of screw 63 (return spring 91 serving primarily to return shuttle assembly 71 to its home position adjacent end plate 65 under both normal conditions and in case of power outage or the like).

Figure 6:
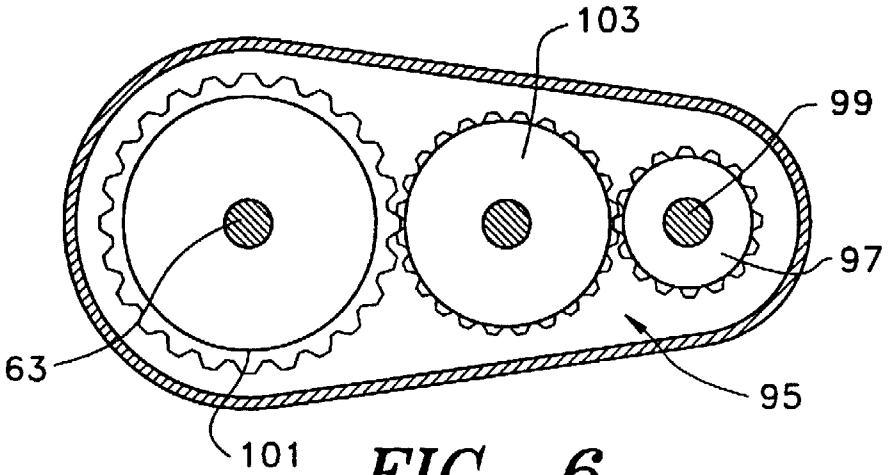
FIG. 6 is a sectional view taken through section lines 6—6 of FIG. 4.
Figure 5:
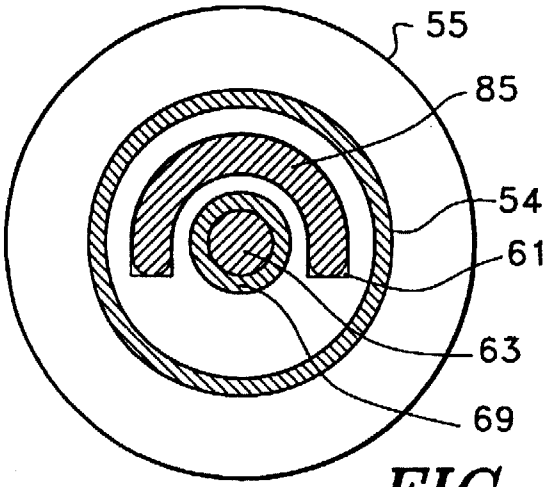
FIG. 5 is a sectional view taken through section lines 5—5 of FIG. 4.
Figure 7:
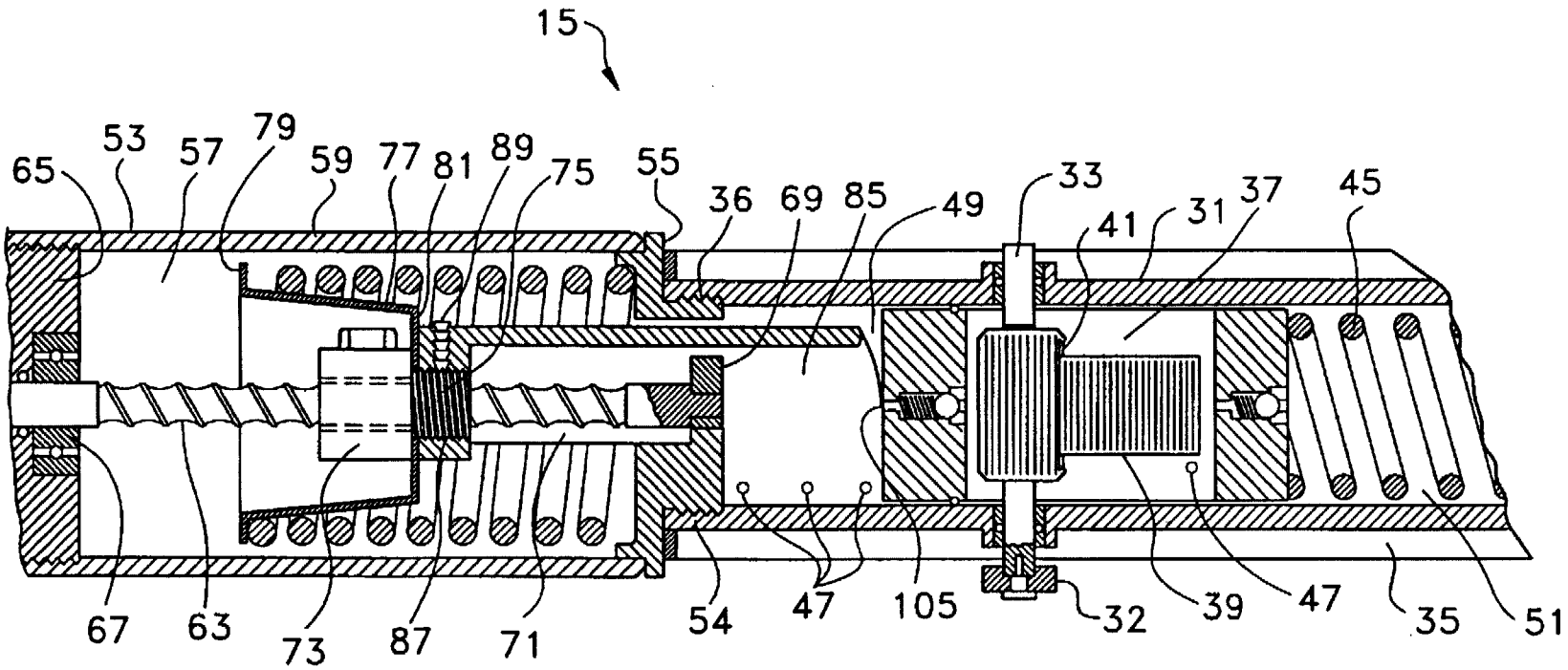
FIG. 7 is a sectional view illustrating the apparatus' position after initiation of assistance with door opening.

Drive motor 93 is mounted adjacent to unit 53 and drives lead screw 63 through gear train assembly 95 (though a belt and pulley or chain and sprocket arrangement could also utilized). As seen in FIGS. 2 and 6, assembly 95 includes drive gear 97 connected with motor output shaft 99, main drive gear 101 having screw 63 connected thereto, and idler gear 103. Any suitable gear ratio to the selected task may be utilized.

Chamber 57 housing shuttle assembly 71 also serves as a hydraulic fluid reservoir to effectively equalize normal hydraulic operation of mechanism 31 (rather than serving any operational function, other than lubrication, in unit 53). Housing 59 is thus sealed utilizing appropriate means to avoid fluid leakage.

Shuttle 85 and opening 61 are configured (in a semicircular cross-section) so that rotation of shuttle assembly 71 is prohibited during operation of the apparatus and to prevent blockage of fluid flow through piston 37 when shuttle 85 is in contact therewith.

Under selective control as discussed hereinbelow, end 105 of shuttle 85 is brought into contact with piston 37 of mechanism 31, but is not rigidly attached to it. When screw 63 is rotated, the shuttle will deliver a desired force against piston 37 (ranging from a user assisting force, effectively reducing, but not eliminating the user force required to open the door, to sufficient force to automatically open the door). Upon completion of the opening cycle, shuttle assembly 71 is returned by spring 91, though embodiment of the apparatus could be conceived whereby assembly 71 is moved away from piston 37 by rotation of screw 63 by motor 93 (and only in the case of a power down, by the unloading of spring 91). Mechanism 31 thus functions in its traditional mode to control door closing.

As will be discussed hereinbelow, the return characteristics of piston 37 are monitored by apparatus 15 to assure proper return characteristics, operation of motor 93 under the operational controls of the apparatus during closing allowing braking of the piston if predetermined desired return speed parameters are exceeded (for example, if the guidelines of A.N.S.I. A 156.19 are exceeded) or if an obstacle is sensed in the doorway.

Apparatus 15 can be used for entranceways accessible to handicapped or disabled persons according to the requirements of the Americans with Disabilities Act, and includes a power assist override mode in which the adjustable opening force is reduced to 0.5 to 5 lb. and an automatic opening mode. Either mode meets A.N.S.I. A 156.19-1990 requirements for low-energy automatic and power assist door operator. The normal mode of operation of apparatus 15 is as a manual door operator (i.e. user push open and hydraulic/spring close) and, in this mode of operation, meets all of the requirements of a grade 1 door closer as delineated in A.N.S.I. A156.4 (1991).

Thus, in the manual mode of operation, apparatus 15 functions exactly like mechanism 31 would function alone (i.e., the presence of unit 53 is transparent to the user). A handicap override, initiated by either a push plate, remote IR or RF link, or by a push and go circuit, activates the selected powered opening mode of operation (which selection is performed at the factory or in the field by the installer).

In the power assist mode, the operation of apparatus 15 results in reduction of the opening force so long as the door is being opened or as long as an optional presence sensor indicates that someone is in the swing area of the door. The door does not self open in this mode of operation. Instead, the disabled person is assisted in opening the door by application of force to piston 37 while yet requiring one to push the door open and pass through the doorway.

If the user applied opening force on the door is released, the door comes to a stop and either immediately begins to close or begins to close after a field adjustable period of time (adjustable from 5 to 60 seconds). The time delay is reset automatically as long as the door is being opened, or a presence sensor indicates that a person is in the active swing area of the door. The time delay is also automatically reset in the event that the push plate, or other input device, is reactivated.

In the fully automatic opening mode of operation, door opening speed is controlled such that the kinetic energy of the door never exceeds 1.25 ft-lb. This mode, when selected, is also activated by a push plate, IR or RF remote link, or by the push and go feature. Safety and time delay features, as discussed above are also employed in this mode.

For both modes, if a power failure occurs while the door is being opened under power, spring 91 will return shuttle assembly 71 to its home position and the door will close as always under the influence of mechanism 31 without impact on closing motion from assembly 71. Until power is restored the operator will default to its normal (manual) mode of operation. Optional battery backup package 109 (FIG. 2) allows up to 1 hour of powered emergency operation of the door.

In either of the powered modes of operation, the apparatus tolerates pedestrian interference at any point during the opening or closing cycles of the door. If a pedestrian attempts to arrest the motion of the power assisted door, a maximum of 15 lbs. applied 1" from the latch edge of the door will stop the motion of the door. If a pedestrian attempts to arrest the motion of an automatically opening door, power is quickly removed from motor 93 so that the kinetic energy (1.25 ft-lb. maximum) of the door can be overcome by the pedestrian. If a pedestrian attempts to speed up the motion of the door, the apparatus provides the usual resistive force of mechanism 31.

During the closing cycle of either powered mode of operation, piston 37 and shuttle 85 can be caused to remain in continuous feather contact or in braking contact (as discussed below, the controller is able to detect the closing force of the piston on the shuttle). If controller 113 senses that the piston is not pushing against the shuttle at any time during the closing cycle, it will stop closing the door and balance the forces on the door by utilizing the assist capability of the controller (fully automatic opening mode) or reactivate the power assist (power assist mode).

Two doors may be configured for simultaneous opening (e.g. side by side doors) or for the delayed opening of the second door (e.g. for a vestibule application) utilizing the apparatus of this invention. For simultaneous opening of two doors, an actuating signal is sent from the chosen input source to the controllers of two apparatus 15. The vestibule function provides for the opening of the second door as soon as the first door has completed its closing cycle by using the slave connections on both controllers, the slave connection operating as an output on the controller of the first door and an input on the controller of the second door. A safety switch (or a pair of safety switches, one associated with each door) is provided in the vestibule area which, upon actuation, will serve to open both doors.

Turning now to FIGS. 2, 8A, 8B and 9, apparatus 15 receives power at the "LINE IN" terminal block. The line is appropriately fused. The line voltage is switched by "POWER" switch 164 and applied to the power supply 110 transformer primaries. The transformer secondaries are connected in series and the resulting 15 Vdc (nominal) is sent to the controller. "MODE" rocker switch 154, motor 93, battery module 109 and motor shaft encoder 111 are connected to controller module 113. The installer may connect a number of devices to the "EXTERNAL" options terminal block of the controller module.

Regulator 114 filters the 15 Vdc (nominal) signal from power supply 110 the signal to provide +20 Vdc supply. This supply powers motor driver 115, electric strike driver 117 (a device to unlatch an electrical door locking mechanism), the electronics, a 5 V regulator and any external sensor, and is available to provide charging current for the optional battery adapter.

Clock 120 generates 12 MHz for processor 121 using a crystal. This clock is also used by pulse width modulator 123. Regular pulses are generated which reenable COP (Computer Operating Properly, also called a watchdog) circuit 125 which includes a D-type flip-flop that is reset at power-up. The pulses are AC coupled, so that their absence can be detected regardless of the level of the output. In the absence of such pulses, after a small delay, the flip-flop is set. This in turn activates a transistor which disables motor driver circuit 115 (the controller does not reset COP circuit 125, but rather resetting is achieved by cycling the power off and then on).

Through port 127 processor 121 reads the state of the devices connected to the "EXTERNAL" options terminal board and from the "MODE" switch. These lines are pulled up to the +5 V or the +20 V supply and filtered to decrease noise and to isolate the processor from any surges.

Through port 129 processor 121 reads the state of DIP switches 133 (installation and mode selection switches). Through port 135 processor 121 reads the setting of adjustment switches 156 and 160 (opening time/force and closing delay time controls as discussed herein after). It also reads the motor current and the voltages on the two motor terminals (at 144).

Processor 121 uses port 136 and port 140 (at "DIR") to read motor shaft encoder 111. The encoder phases drive D-type flip flop 138, the output from which remains high if the motor turns in the direction of opening the door and low otherwise. At each processor interrupt generated by one of the phases (at port 136), processor 121 reads the state of the output from flip flop 138 (at port 140) to determine motor direction, and measures the time elapsed since the previous interrupt to calculate motor speed.

Processor 121 drives an optional electric strike plate through a power current source which uses a darlington transistor. Processor 121 monitors the collector voltage of the darlington transistor at port 140 to determine if an electric strike is installed. A rectifier bridge allows the use of DC and/or AC strike plates.

Through port 137 processor 121 drives a two color LED 139 to report system status (faults or the like), and reads the settings of the "SIZE" and "ANGLE" adjustment switches 162 and 158 respectively (operator set switches to indicate the size of door with which the apparatus is connected and opening angle to back stop).

Clock 120 provides modulator 123 with a byte proportional to the desired duty cycle (On time). The two synchronous binary counters divide the 12 MHz clock down, counting from 0 to 255 and then again from 0. The count repeats at a 47 KHz rate. The two 4-bit comparators compare the instantaneous count with the modulator byte from processor 121. While the count is less, the comparators' output is high. This results in a 47 KHz square wave whose On time is proportional to the modulator byte. Through the PWM Enable line at port 140, the processor may clear the counters to disable driver 115.

Motor driver 115 powers motor 93 using a quasi-H bridge circuit formed by a pair of field effect transistors (MOSFETs) and two fast fly-back rectifiers with motor 93 in the horizontal arm of the bridge. When the MOSFETs are on, power is coupled to motor 93 in the forward polarity. When the MOSFETs are off, the current in the motor's inductance is diverted through the fly-back rectifier diodes back into the supply.

This arrangement allows the motor to be driven in one direction and to be braked in the opposite direction. When a door associated with the apparatus of this invention is closing, the motor becomes a generator. By turning the MOSFETs On, they connect power to the motor thus allowing braking of a closing door if desired.

At motor monitor 144, one of the MOSFETs' current is routed through a current sense resistor. An OP-AMP amplifies the voltage across the resistor and sends it to port 135 of processor 121. Two resistor dividers sample the voltages at either end of the motor and send them also to port 135 of processor 121.

The optional battery adapter (109 in FIG. 2) includes a 12 V rechargeable battery pack, a rectifier to allow full battery current to power the controller, a fuse to protect the battery from accidental shorts, and a charger. While the operator is AC powered, the controller provides the battery adapter with an unregulated +15 Vdc nominal. The rectifier is reverse biased and the adapter charges its battery with this voltage through the charger. While the operator AC power is removed, the full battery voltage is available to the controller through the rectifier and the fuse.

The servo system thus defined operates as a squaring-integrating type. A reference (current, velocity or both) is compared to actual readings. The error is amplified and integrated. Depending on the magnitude of the error, this integrand is either a linear or a square function of the error. This method results in a self-adjusting servo, the gain of which is large for large errors and decreased for smaller errors. The integrand is subtracted from the integral (in order to generate negative feedback, drive is decreased for a positive error and increased for a negative error). The resulting servo drive signal is output to pulse width modulator 123 driving motor 93.

The software timer is continuously incremented. It is restarted each time a new operating state (as discussed hereinbelow) is entered. Controller 113 checks each variable to assure it is within the expected limits for the given operating state. Specifically, it checks the motor current, shuttle velocity and the real timer. The controller also checks the ROM through signature analysis and proper operation of the RAM.

Figure 10A:
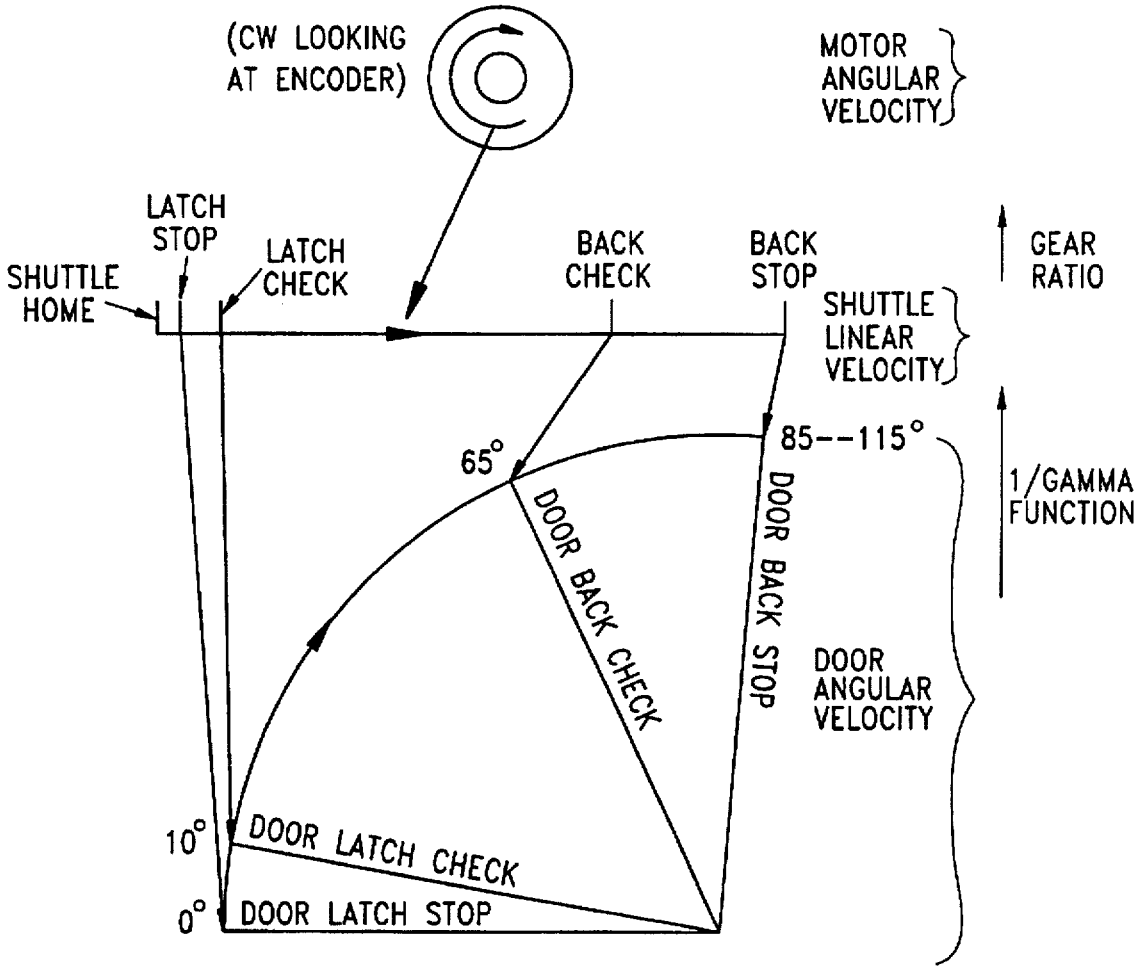
FIGS. 10A through 10D are charts illustrating operational control of the apparatus of this invention.
Figure 10B:
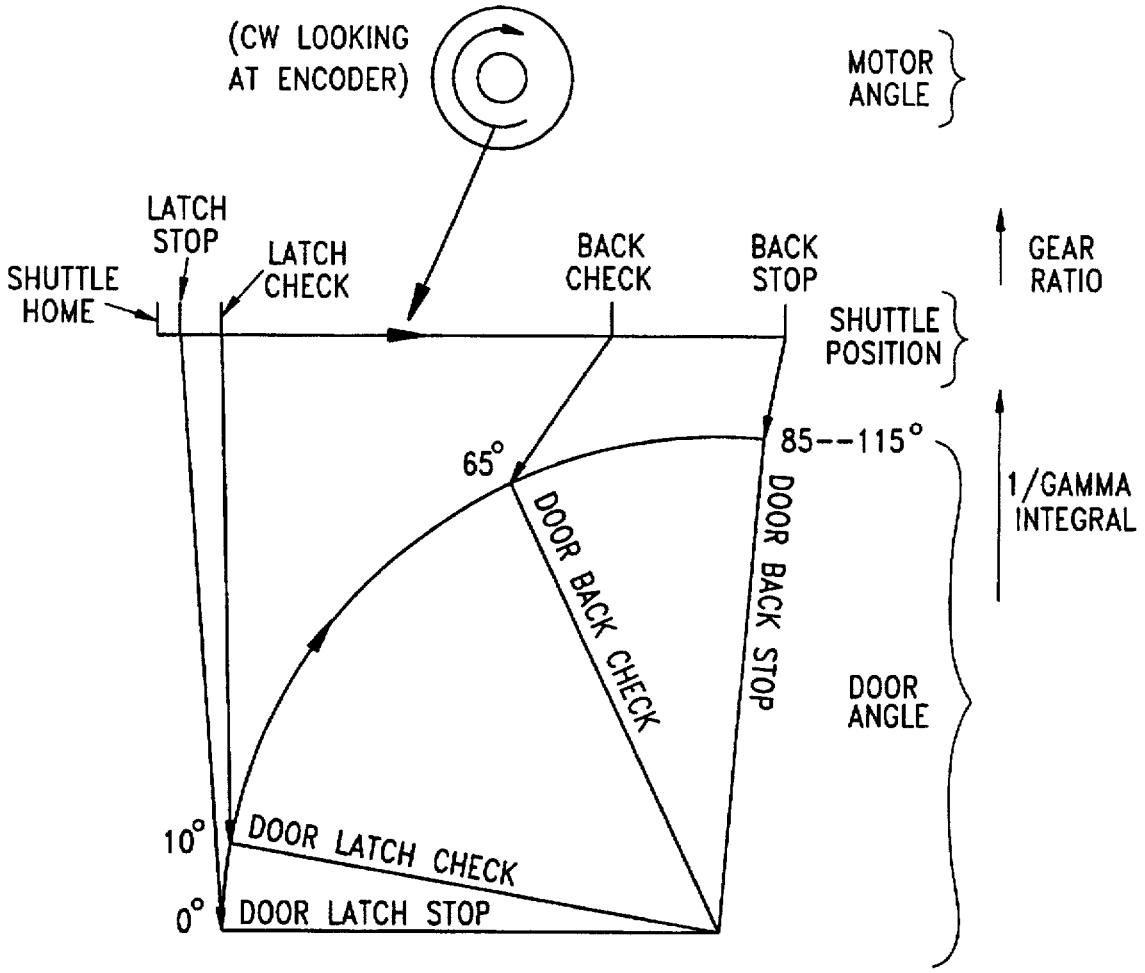
Figure 10C:
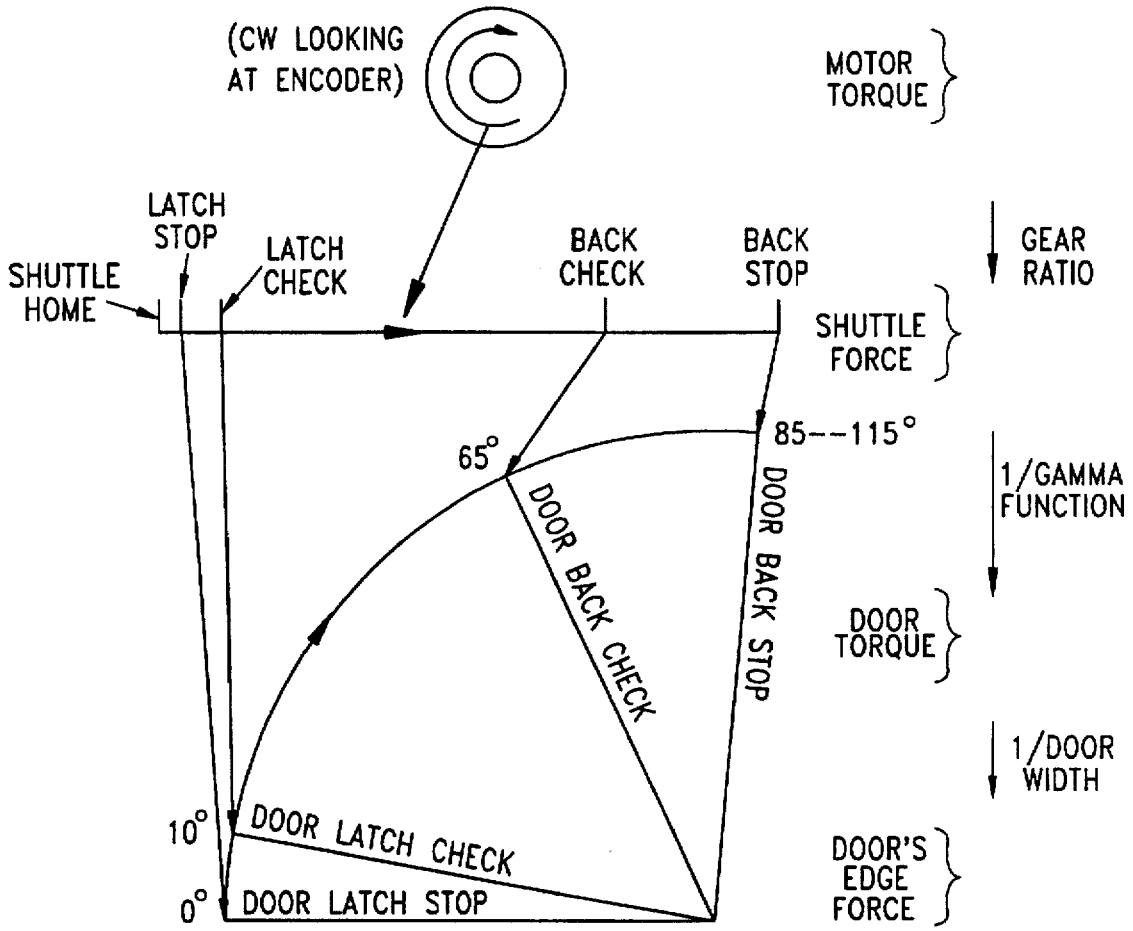
Figures 10D, 10E, 10F, 10G:
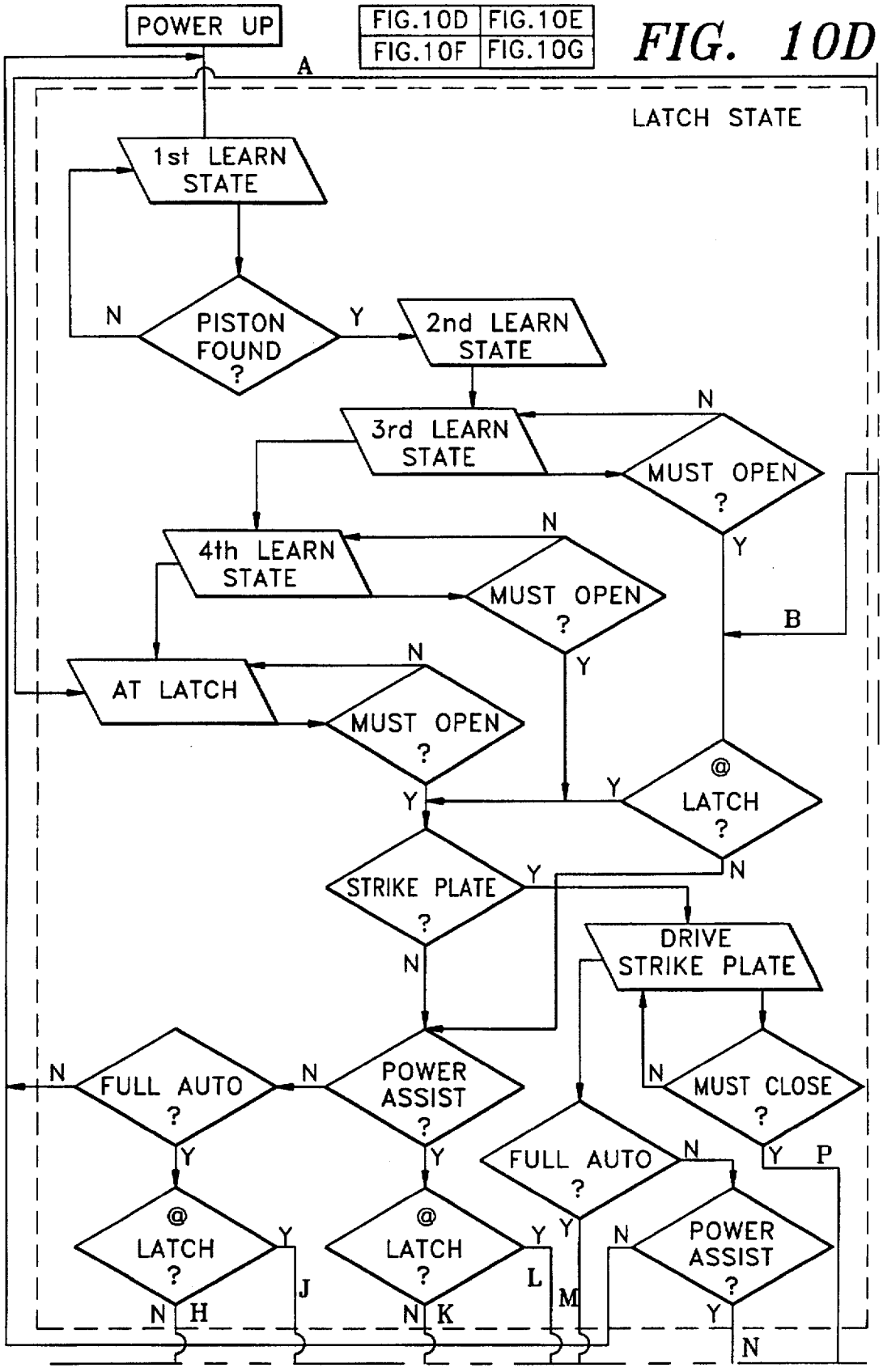
FIGS. 10E–10G are flow diagrams of the controllers of the different embodiments of the apparatus.
Figure 10E:
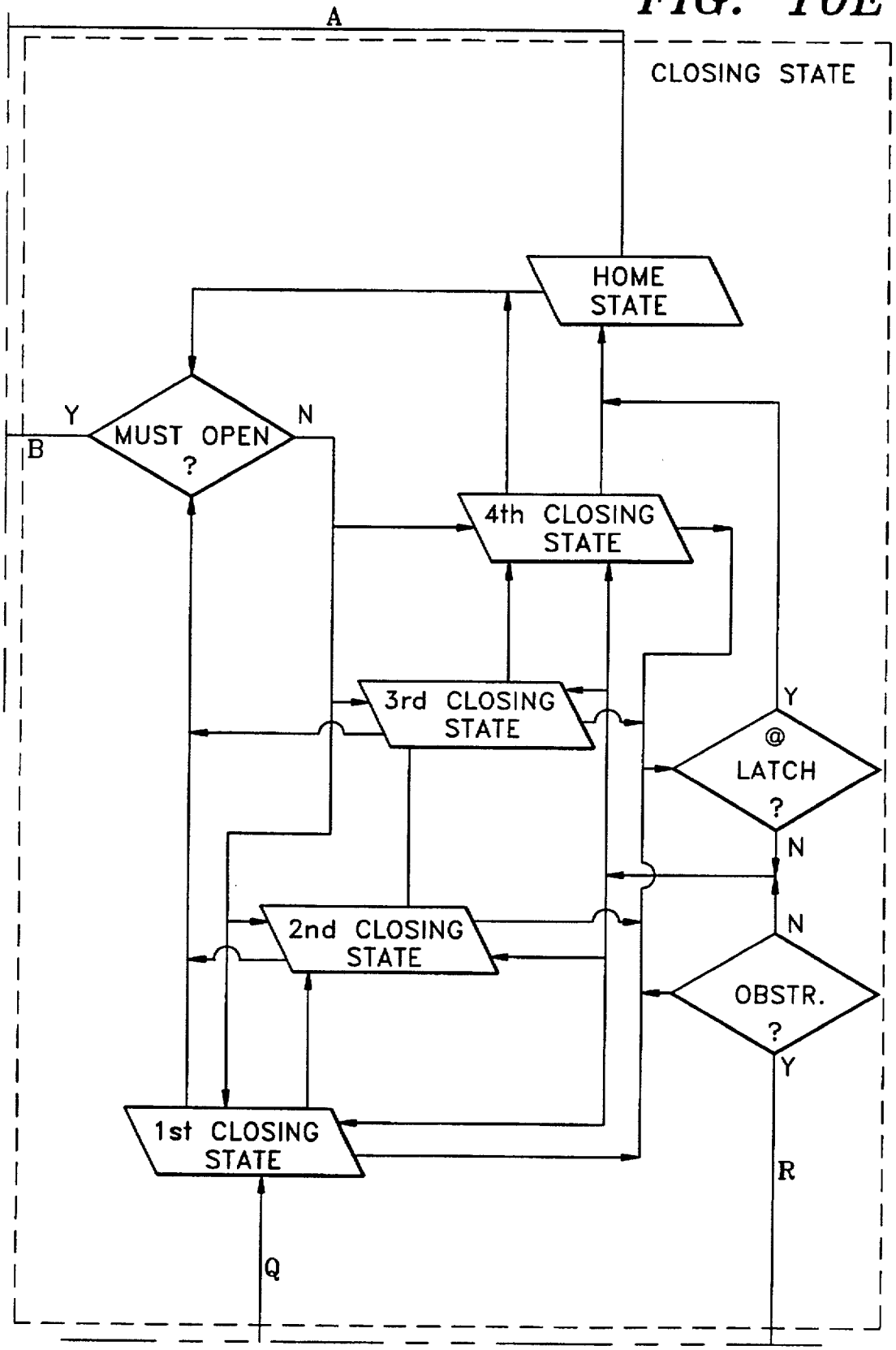
Figure 10F:
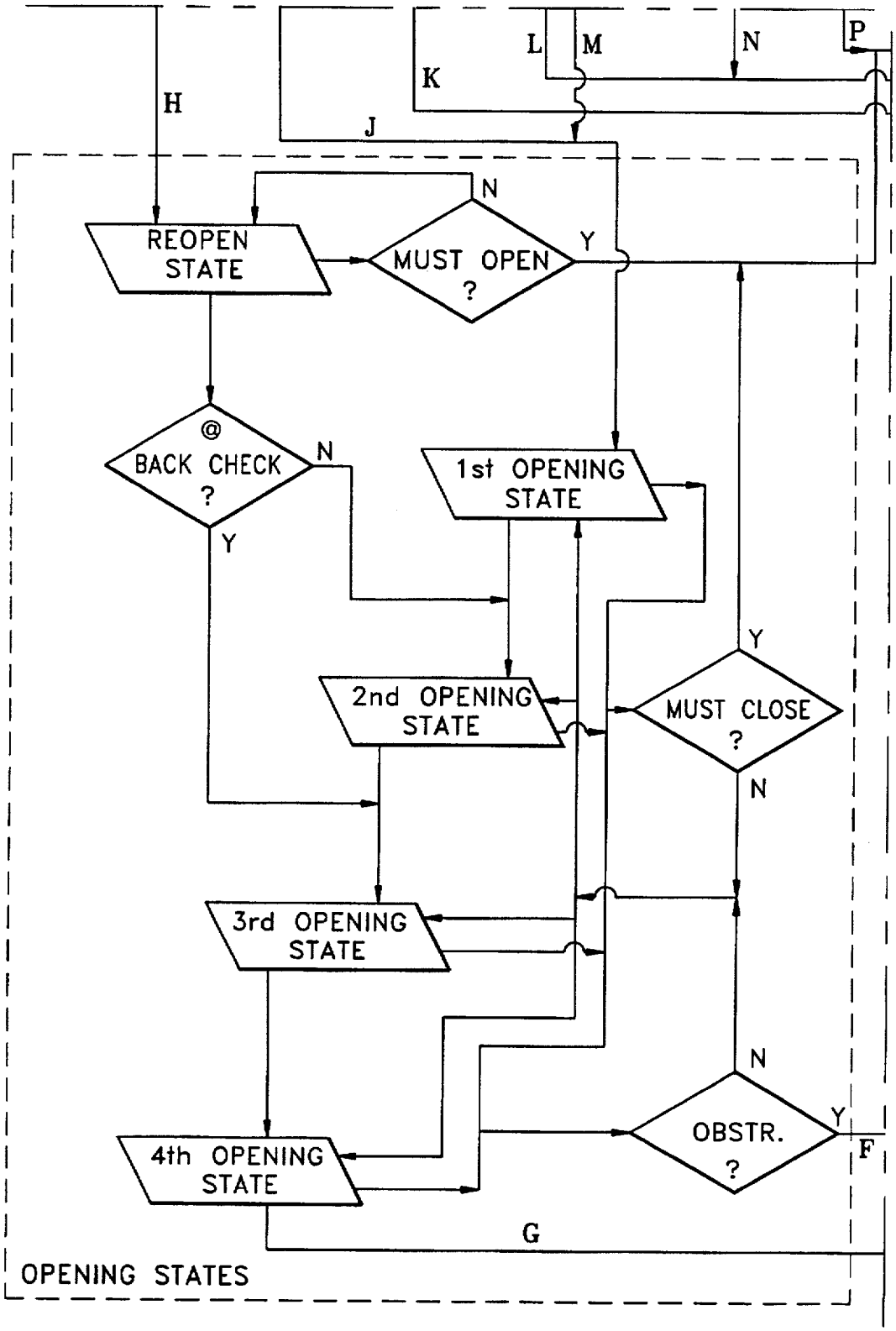
Figure 10G:
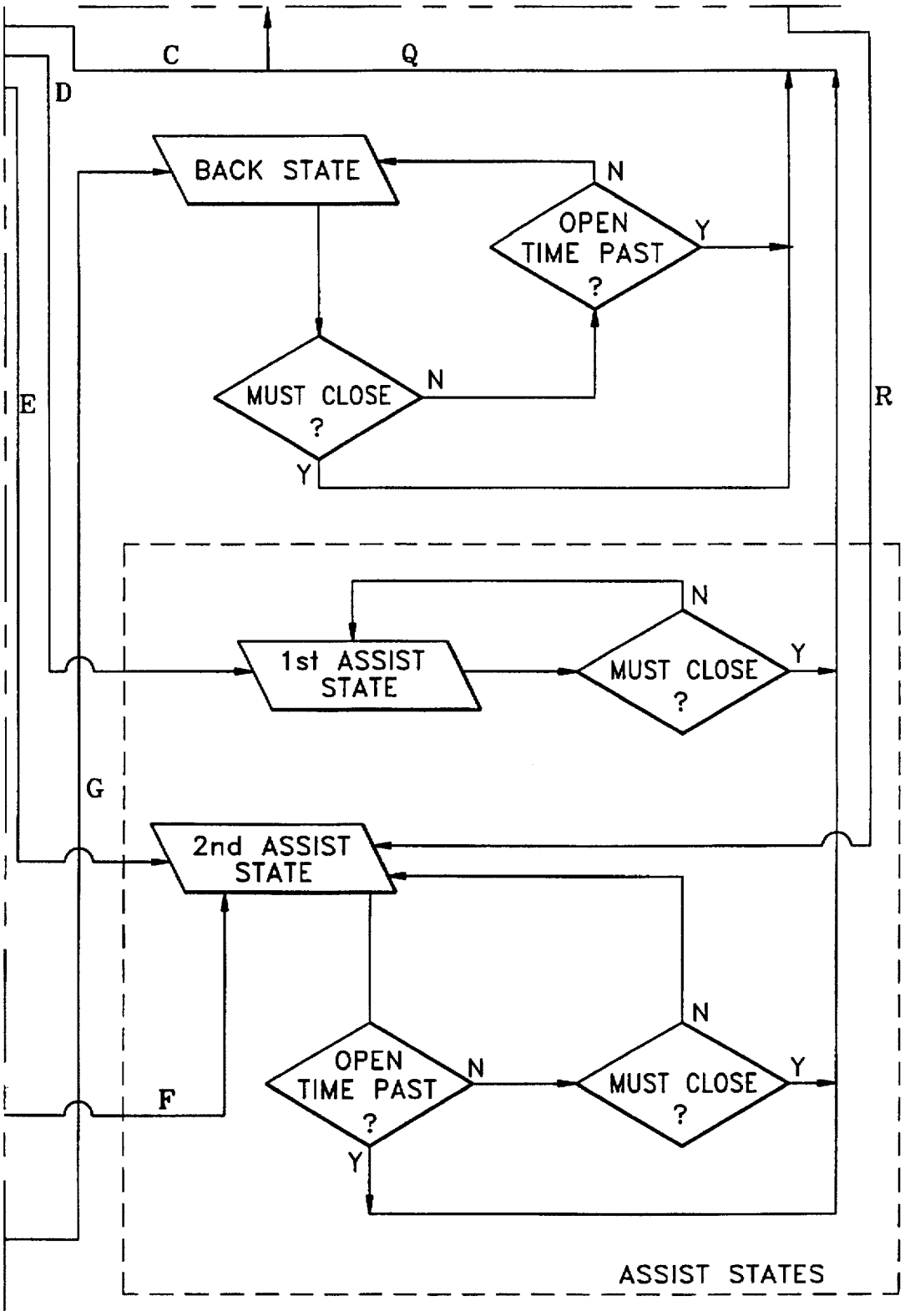

Controller 113 operates basically as a state machine under program control as illustrated in FIG. 10D for operational control of the apparatus of this invention. Information utilized for control as described hereinbelow is gathered and or sensed from various sources (for example, from standard and known operating parameters of motor 93 and springs 45 and 91, gear ratios of gear train assembly 95, operator settings, unit configuration at DIP switches 133, current and voltage monitor 144 and shaft encoder 111).

The relationship between the door and motor angles, between their torques and between their velocities are non-linear. They depend on the non-linear coupling between the operator and the door (i.e., control arm 32 for push open mountings or sliding track arms or the like for pull open mountings). Mechanics of these non-linear couplings are internally computed and utilized in controller 113 through use of the gamma function, the ratio of input to output velocities and the inverse ratio of input and output torques. The gamma function is angle dependent and, in the case of non-linear couplings, is a variable ratio.

The gamma function determines the response at the door for a given movement at output shaft 33 of mechanism 31. While the actual gamma function will vary from installation to installation, due to variations in door jamb width, accuracy of installation and the like for example, such variations are, for standard installations, within a range of tolerance such that adequate door control can be achieved by using a single set (related to installation and door size) of precalculated values of gamma verses door angle. For a typical push side mounting, gamma may vary from about 0.2 for the fully closed door to about 0.8 when the door is open to 115°. For pull side mounting, gamma may vary from about 0.5 for a fully closed door to about 1.5 for a door which has been opened to 115°. FIGS. 10A–C illustrate the relationships between motor 93, shuttle assembly 71, output shaft 33, door pivot 150 and door edge 152 (FIG. 1).

Turning now to FIG. 10D, when the unit is first activated (power-up), the program initializes the hardware and enters the Latch group of states, those states in which a closed door remains when not in use and which is initially utilized to learn installation dependent operating parameters such as the position of piston 37 of mechanism 31 when the door is at the fully closed position and the combined preload of springs 45 and 91.

The Latch group of states comprise six states (including three learn states). In the first learn state, shuttle assembly 71 is driven into contact with piston 37. If piston 37 is not encountered within a reasonable parameter, the system is restarted. In the second learn state, the position of the shuttle assembly when in contact with piston 37 of a fully closed door is learned (i.e., the latch-stop position) with reference to sensed motor current from current monitor 144 and shaft encoder 111. Piston 37 is driven just beyond the fully closed position of the door (i.e., just beyond latch-stop).

In the third learn state, the combined spring 45 and 91 preload is encountered and learned with reference to monitored current and shuttle 85 is driven back to a position just in advance of latch-stop. In the fourth learn state, end 105 of shuttle 85 is brought back to latch stop position. Shuttle 85 is then maintained in this position (if the push and go feature is activated at DIP switches 133, shuttle end 105 is pressed against piston 37 in order to sense door movement and to follow piston 37 thereafter). If there is a strike plate, the strike plate is driven and door opening is delayed in the drive strike plate state.

To exit the Latch states, if any of the must open conditions are met (i.e., when the door is at latch stop and a signal is present at the open trigger input to controller 113 indicating an activated push plate, motion detector or the like, when a signal is present at the slave trigger input used in vestibule applications, when the push and go feature is activated and the door is opened a distance from latch stop, or when the door is not at latch stop and a signal is present at the open trigger input or mode switch 154 is set to keep the door open) and any strike plate delay is complete, operational control moves to the Opening states (in the fully automatic opening mode) or the Assist states (in the power assist mode of operation), depending upon setting at the appropriate DIP switch 133.

In the Opening states, the program opens the door to the back stop (respecting A.N.S.I. regulation as to opening speed). In a regular opening cycle with the door starting at the latch stop position (and the operating personnel having preset the desired opening time at the "Open" adjustment switch 156, which is limited to an opening speed within A.N.S.I. specifications, and having established the back stop position at the "Angle" adjustment switch 158), the door is opened with speed increasing linearly until it reaches a plateau velocity. The plateau velocity is such that, as the plateau speed is maintained up to back check (i.e., at about 65° of fully opened), it opens the door in the desired opening time. Past back check, the operator decelerates the door to reach a crawl speed (arbitrarily defined) and continues opening the door at the crawl speed. If a strong back check force is used, the door speed through back check is limited by the power supply's power limitations.

If the Opening states are entered with the door between latch stop and back check, then the door speed is changed from its then current velocity to the plateau velocity of the previous cycle, continuing thereafter as in a regular cycle. If the Opening states are entered with the door beyond the back check position, door opening speed is started at the crawl speed, and then continues as in a regular cycle.

When the door reaches the back stop, the program exits to the Back state. If an obstacle interferes with the opening door, the program exits to the Assist states. During acceleration or at plateau speed, interference is detected if, in order to maintain the speed, the servo must increase the drive to its maximum drive or to the point that it generates a force equivalent to more than 15 lb. at the edge of the door. Past the back check position, this is detected if the door is stopped and the servo must increase the drive to its maximum drive.

The Opening states include six program states. The reopen state reverses a closing door's direction. In the first opening state, the door is accelerated to the plateau speed. In the second opening state the strike plate drive is turned off and the door continues to open at the plateau speed. The door is decelerated to the crawl speed in the third opening state and is brought to the back stop in the fourth opening state.

If the Must Close conditions (i.e., if a signal is detected on the close trigger input to controller 113, for example from a push plate, smoke alarm or the like indicating that the door must immediately close, or if mode switch 154 is set in the don't open position) are met at any point in the Opening states, functional control shifts to the Closing states.

In the Back state the program holds the door at the back stop for the time period established by the setting of adjustment switch 160 by operating personnel and advances a timer. Just enough torque is generated to overcome the force of return springs 45 and 91 to hold the door at the back stop.

If an obstacle is sensed in the door swing area (for example, by signal from a mat sensor, presence detector or like device positioned adjacent to the door way with the signal received at the "Busy Swing Area" input to controller 113), or if the Must Open conditions are met, the program restarts the timer thus further delaying closing of the door. If the timer reaches the set delay time, the program exits to the Closing states. The controller is capable of limiting the delay time in order to prevent overheating of the motor.

In the Assist states, a user of the door is assisted in opening the door by a program controlled reduction of the force required to open the door. Any time the door encounters an obstacle in its swing path, the program will enter these states from anywhere in the program. If the door is at the latch stop, it is moved slightly open (for example, about one inch) to prompt the user. Enough torque is generated to overcome most of the torque due to return springs 45 and 91. This allows the user to move the door with a reduced force.

The force that the user must use to open the door is established from the operating personnel setting of adjustment switch 156 (which has a use different than when controller 113 is set at DIP switches 133 for fully automatic opening mode; when set in the fully automatic opening mode, a default force required to open the door in case of an obstacle is utilized). Again, the closing delay time is established from the setting at "Delay" adjustment switch 160 and the program advances a timer. If the swing area is busy or the Must-Open conditions are met, the program restarts the timer. If the timer reaches the close delay time, the program exists to the Closing states.

The Assist states include two program states. In the first assist state, when a must open signal is received and if the door is at the latch position, the door is stepped forward a short distance to prompt the user. In the second assist state (entered immediately upon receipt of a must open signal where the door is beyond latch stop position or where an obstacle is encountered by the door during any other door function) force is applied to piston 37 by shuttle assembly 71 to assist the user with door opening. If the Must Close conditions are encountered any time during the Assist states, program control shifts to the Closing states.

In the Closing states, shuttle 85 is kept in contact with piston 37 so that, to latch check position (at about 10° from the latch stop), the speed of the door under the control of mechanism 31 is limited to a maximum speed (for example, no greater that allowed under A.N.S.I. guidelines, wherein the kinetic energy of the door must be less than 1.25 ft-lb.), and so that, between the latch check position and the latch stop position, speed of the door is limited to provide a selected closing time therebetween (for example, at least 1.5 seconds). The shuttle is then brought to its home position (disengaged from piston 37). If the shuttle reaches its home position, program control reenters the Latch states. If the Must Open conditions are met, control reverts to the select open state of the Latch states. If the door encounters an obstacle, control reverts to the second assist state.

Door closing speed is limited to a profile within the maximum allowed in A.N.S.I. guidelines. Shuttle assembly 71 lets itself be pushed by return spring 45 to the closed position so long a closing speeds are within the profile, and limits the speed of the piston (i.e., provides braking) when the closing profile is exceeded. Controller 113 operates in these states as a velocity type servo, but with a minimum current, to ensure that the shuttle remains in contact with the piston even if the piston stops. After reaching the latch stop position, shuttle 85 moves to its home position.

The Closing states includes 5 program states. In the first closing state, the door is allowed to accelerate to a sweep speed (as hereinabove limited). During the second closing state the door closes at the sweep speed, decelerating to a latch speed in the third closing state. In the fourth closing state, the door continues at the latch speed until shuttle assembly 71 is brought to its home position in the home state.

It should be appreciated that other closing regimes could be employed, for example, quick return of the shuttle assembly leaving mechanism 31 totally unencumbered during the closing cycle, intermittent contact upon return to check closing speed, or the like.

In the field, the apparatus of this invention would normally be shipped from the factory with DIP switches 133 preconfigured for a push or pull side mounting, a left or right hand swinging door, fully automatic or power assist mode of operation, and external trigger (push plate or the like) and/or push and go operation where, when the moving vertical edge of the door is moved in the opening direction about one inch, the power open or power assist function is automatically activated.

A push side mounting uses a 2 link connecting arm between mechanism 31 and the door. The pull side mounting uses a single connecting arm and a slide track which is mounted along and parallel to the top edge of the door. A door which opens away from the user and has the hinge on the right side is a right hand door. A door which opens away from the pedestrian and has the hinge on the left side is a left hand door.

Any of the above factory settings can be changed in the field with little difficulty by resetting of DIP switches 133. Manual closing force can be adjusted with a simple screw type adjustment.

Once the apparatus of this invention has been physically secured in place and connected with either the existing mechanism 31 or, in the case of an integrated unit, connected with either the two link arms or the slide track (depending on whether a push or pull mounting) to the door, the installer sets the adjustments of the manual door closing mechanism 31 as is well known by those skilled in the field.

These adjustments normally determine the parameters of motion of the door during manual opening and the closing portion of its cycle, and include the closing force adjustment, set within the approximate range of 5 lb. to 11 lb., sweep speed adjustment at the sweep valve to set the closing speed between the fully open position and approximately 10° open, latch speed adjustment at the latch valve to set the closing speed between 10° open and fully closed, and backcheck adjustment at the backcheck to set the opening resistance at about 65° of door opening (a hydraulic damping force whose magnitude increases with increasing door velocity, typically between about 0 and 30 lb. under normal operating conditions).

Figure 8A:
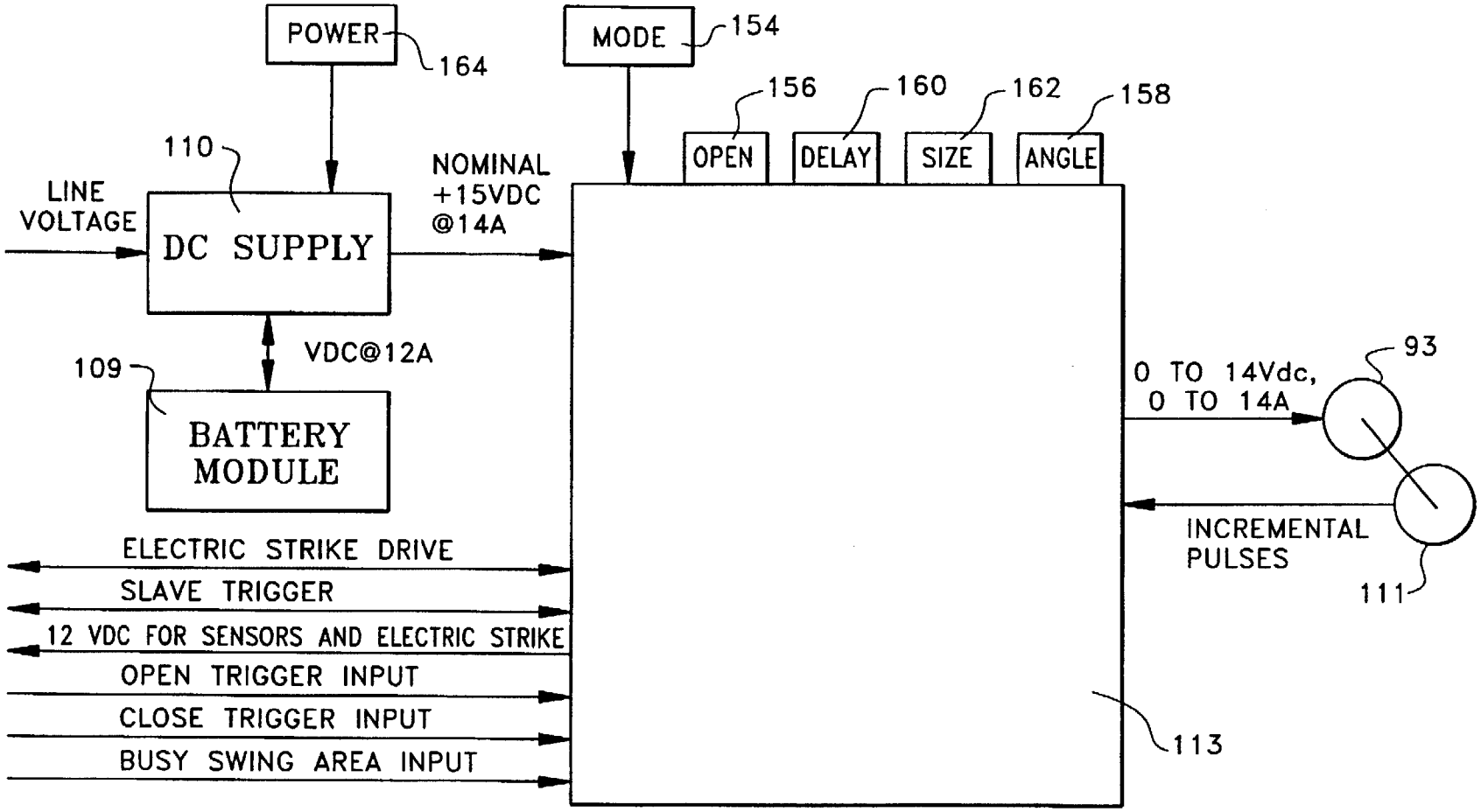
FIG. 8A is a block diagram of the operational controls of the apparatus of this invention.
Figure 8B:
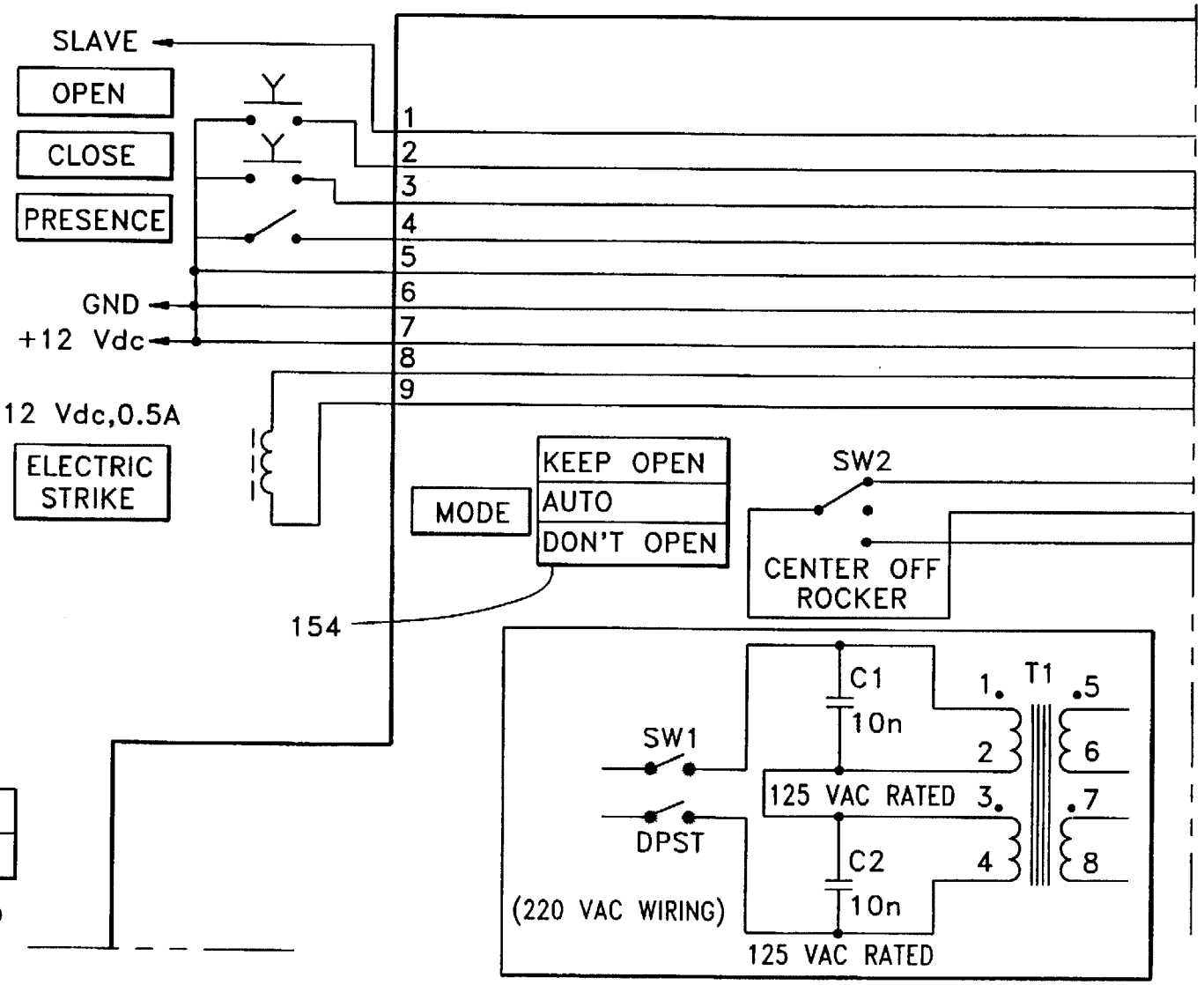
FIG. 8B is a schematic of the operational control circuitry of the apparatus of this invention.
Figure 8C:
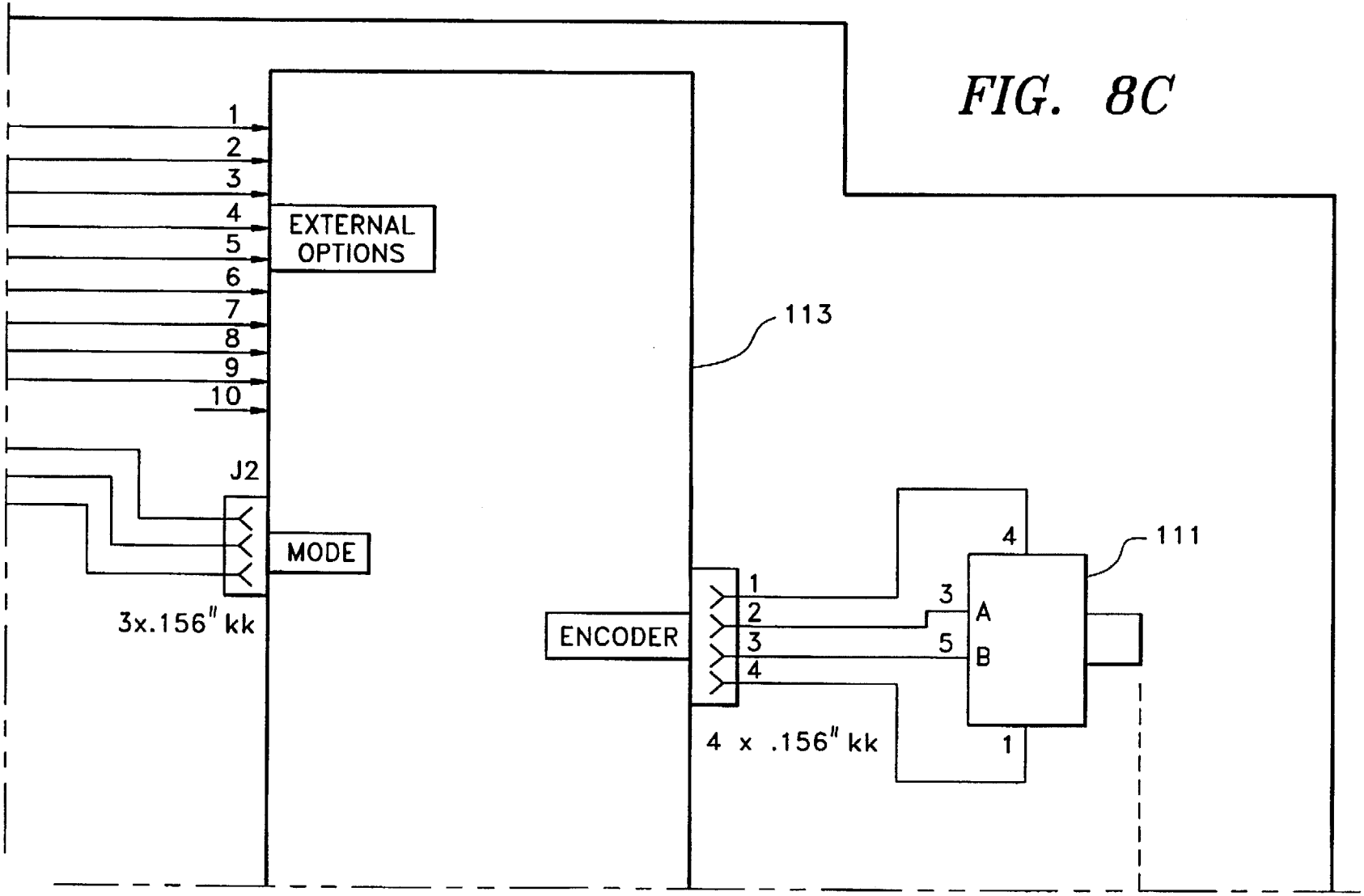
FIGS. 8C–8E are schematic diagrams of the operational controls of the different embodiments of the apparatus of the invention.
Figure 8D:
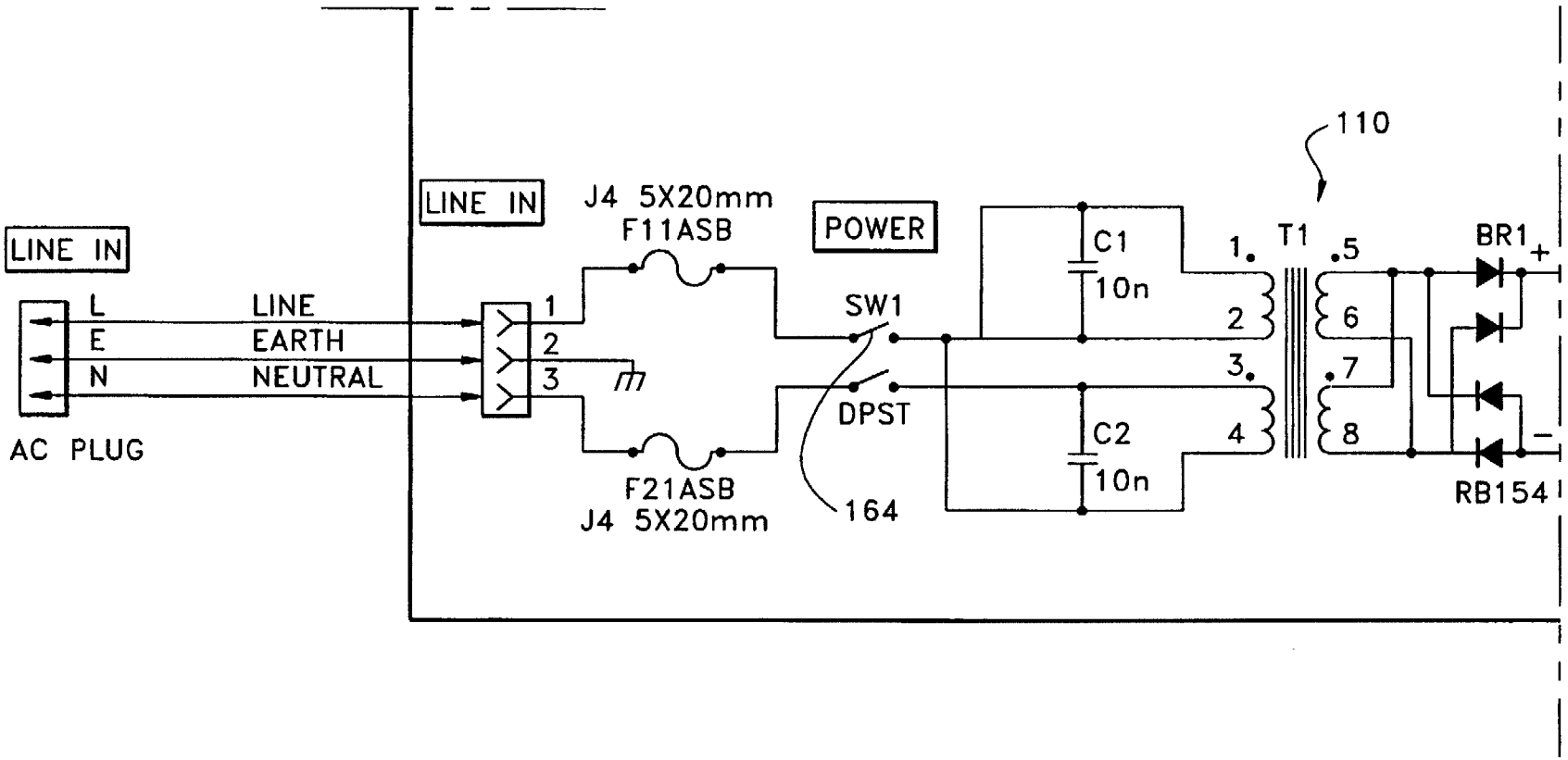
Figure 8E:
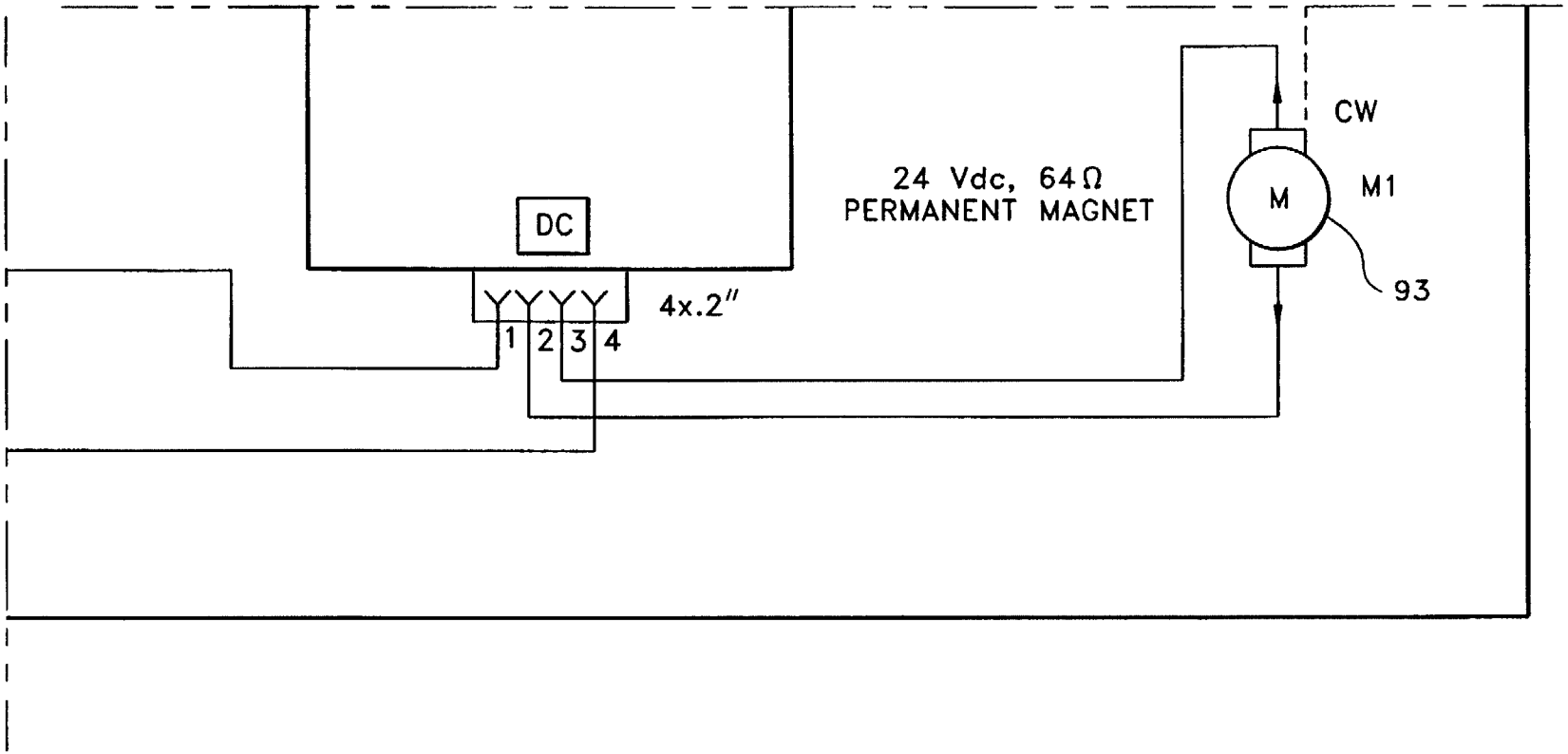
Figure 9A:
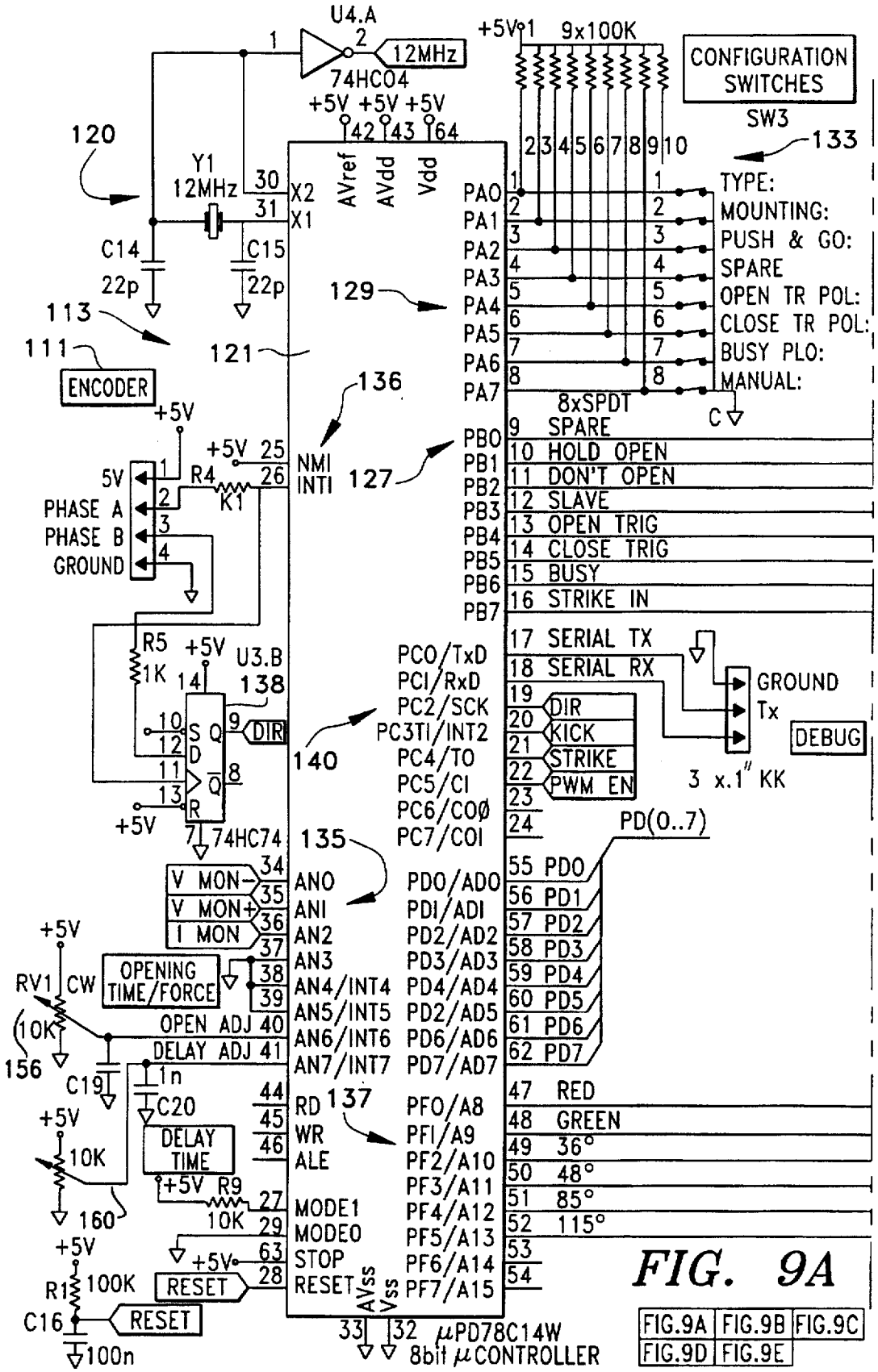
FIG. 9 is a schematic of the controller of the apparatus.
Figure 9B:
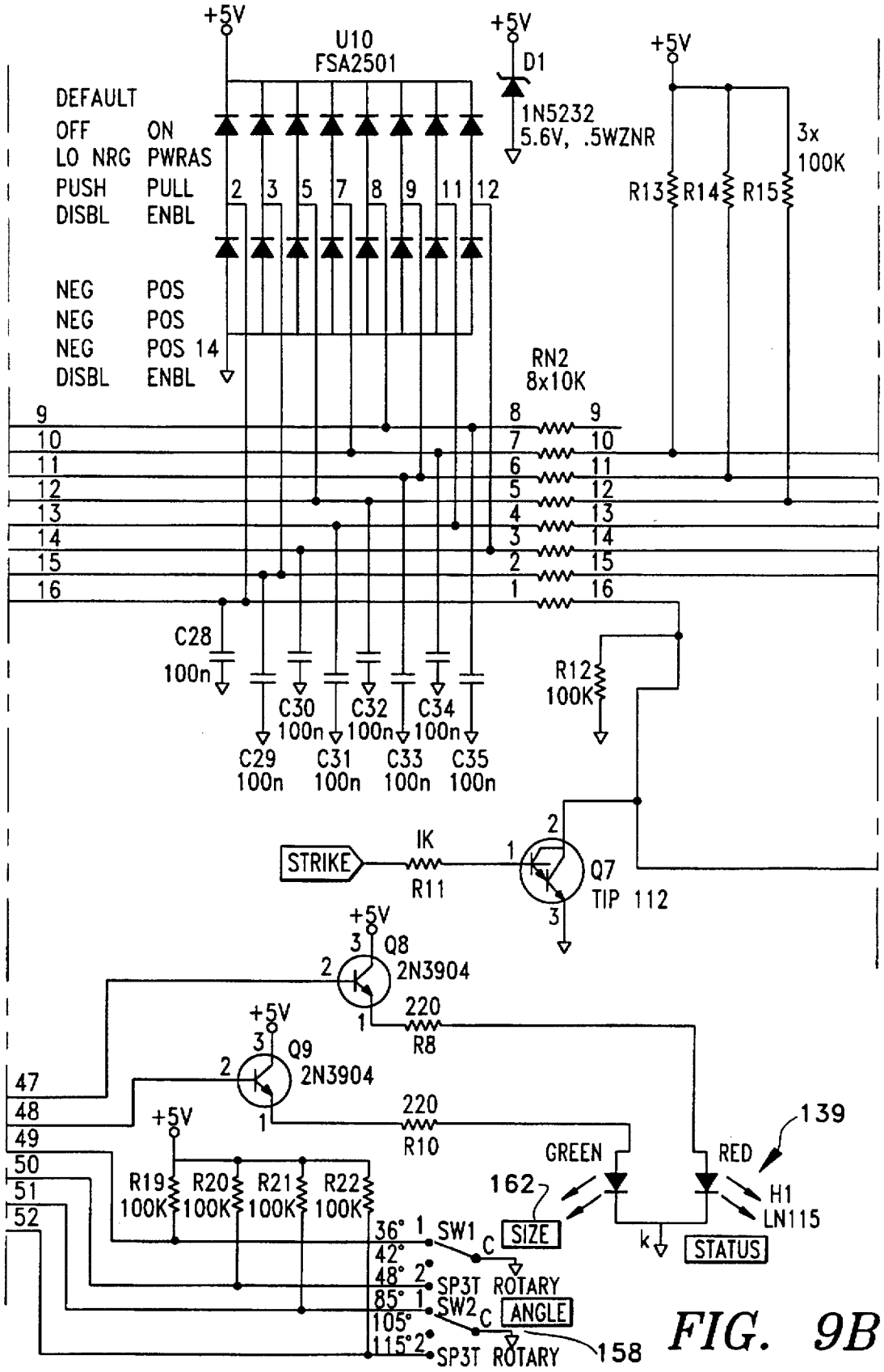
Figure 9C:
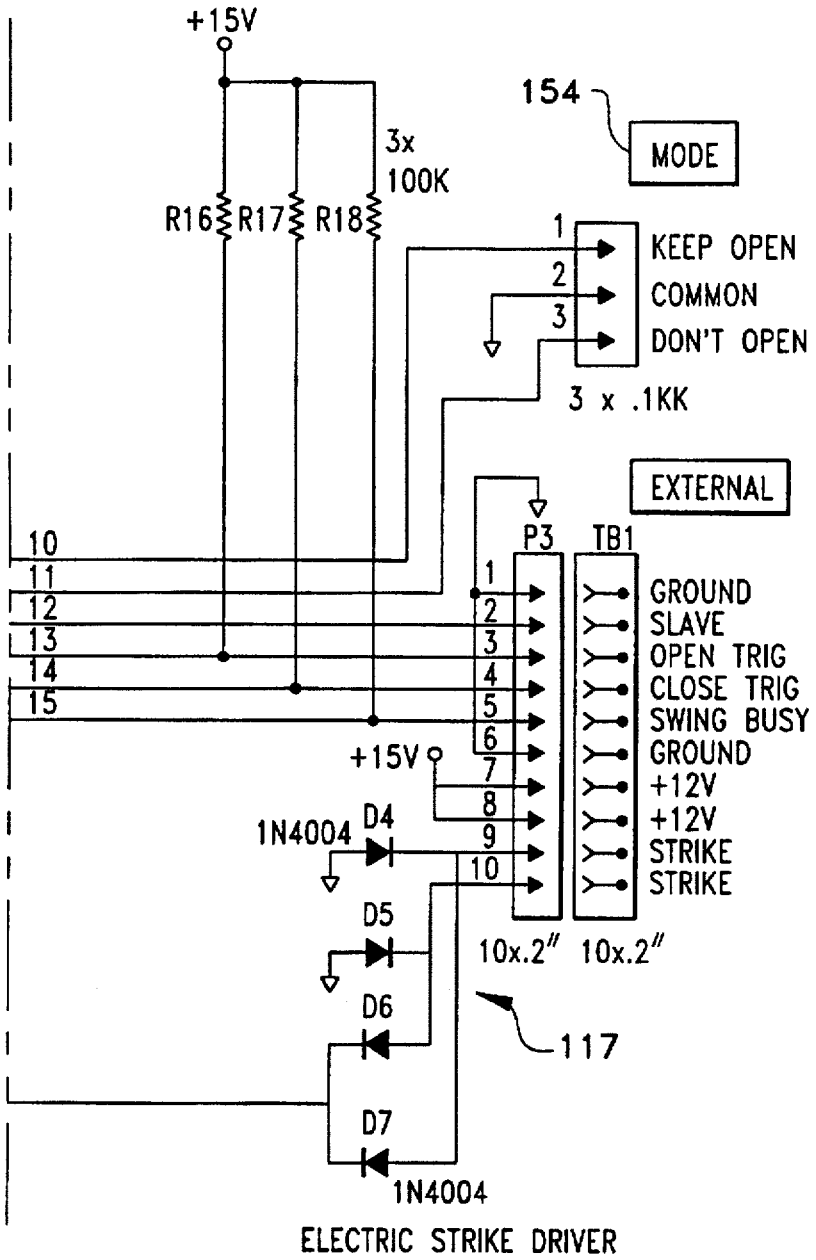
Figure 9D:
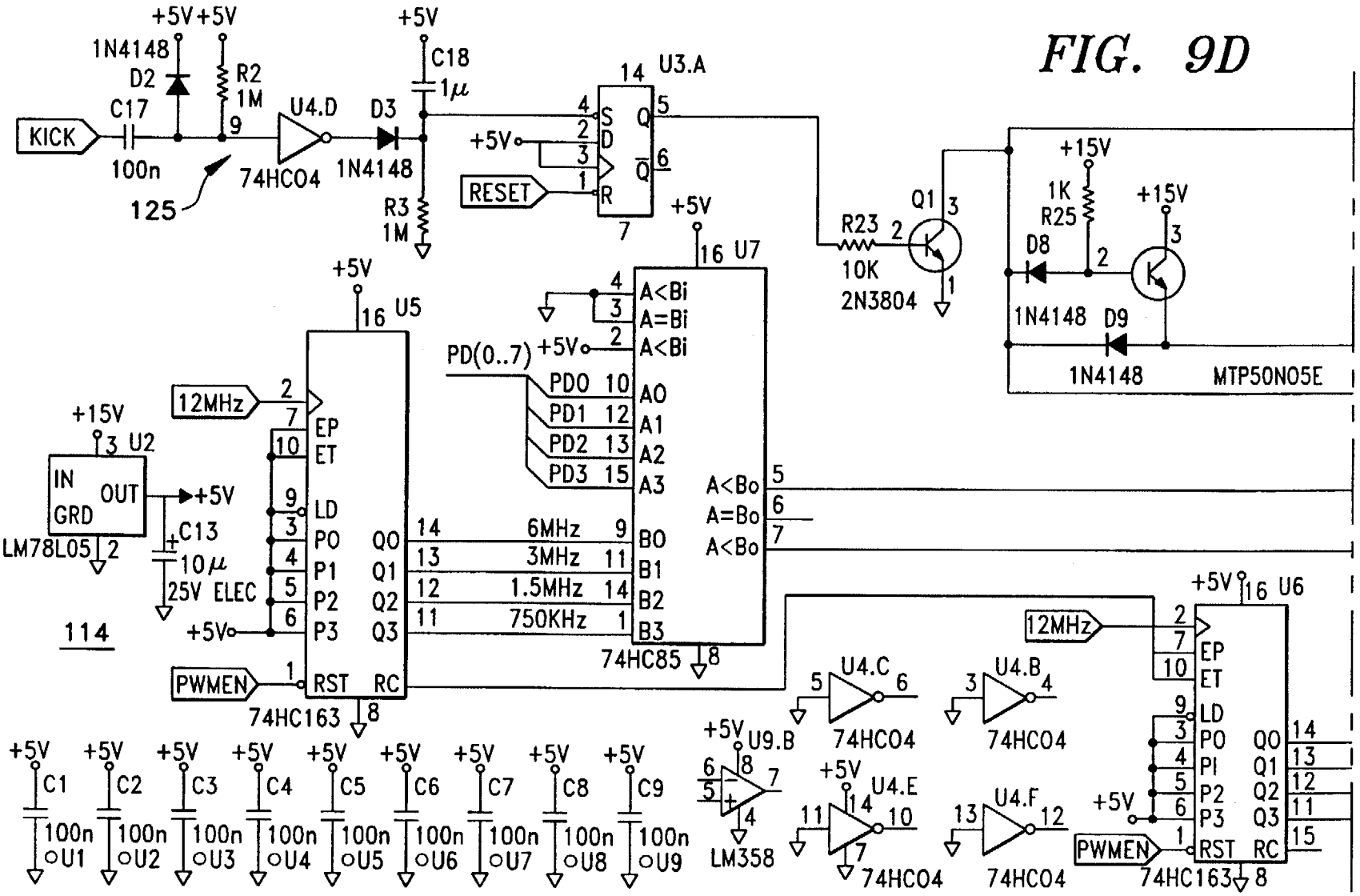
Figure 9E:
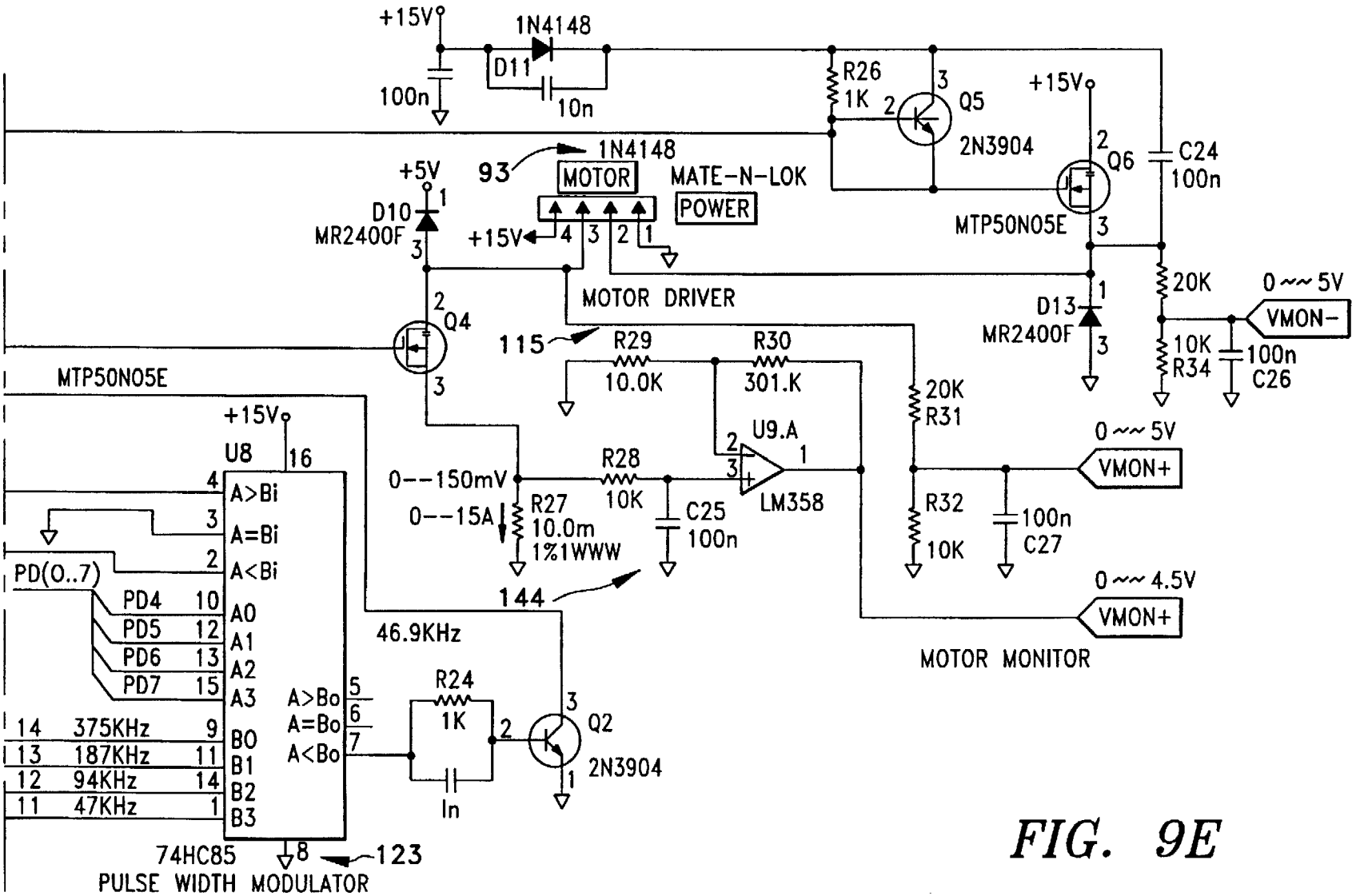

Referring to FIGS. 2, 8A and 9, the installer then makes four adjustments which control the behavior of the door during the fully automatic or power assisted opening portion of the door motion (depending upon factory configuration).

If controller 113 is configured in the fully automatic power opening mode, adjustment switch 160 is used to set the amount of time that the door delays in the fully open position before it begins closing. The range of adjustment is typically between about 5 seconds to 60 seconds. Adjustment switch 156 is used to set the time to open from fully closed to about 65° of opening. An opening time range is established by this setting, with the difference between minimum opening time and maximum opening time being, for example, about 10 seconds. The upper and lower limits of opening time are, however, dependent upon door size setting.

Adjustment switch 158 is used to set the angle to which the door opens when opened under power (i.e., establishing the back stop). The range is about 85° to about 115°, but the exact limits of the opening adjustment depend upon the particular installation. For example, the reveal, or distance, between the face of the door nearest the operator and the vertical surface to which the operator is mounted, will affect the range of door opening angles. Rotating the switch in one direction increases the opening angle, while rotating the switch in the opposite direction decreases the opening angle. Adjustment switch 162 is used to set the door size. It may be provided with three positions which correspond to small, medium and large doors, or may be a continuously variable switch.

If controller 113 is configured for operation in the power assist mode, adjustment switch 160 is used as before to set the amount of time that the door holds the final position to which it was pushed open before it begins closing. Adjustment switch 156 is used to set the amount of force that is required by the user to open the door from approximately fully closed to any open position up to about 115° of opening. The opening force range is between about 0.5 lb. to about 5.0 lb, irrespective of the size of the door or the closing force set by the installer. Adjustment switches 158 and 162 are used as previously described.

Once these adjustments are made, the installer installs any external devices which may be desired, such as a push plate or open switch, safety mat, presence sensor, motion detector, RF link or the like, and makes any systems connections which may be desired (for example, connection with the fire alarms of the facility, or the like). Power supply is established through any standard receptacle.

Power switch 164 turns the power to the unit on or off. Mode switch 154 may be set as desired for power assist or fully automatic opening (depending on controller 113 configuration) in the central position. Switch 154 rocks to either side. Rocking the switch in one direction causes the door to be continuously held open. Rocking the switch in the opposite direction triggers the controller to close the door and prevents further powered reopening. Alternative switch arrangements could of course be utilized.

In the normal, or manual, mode of operation the user simply opens the door as usual by manually pushing or pulling on it. The opening is resisted by the spring force of mechanism 31. Door closing is accomplished and controlled by mechanism 31 which uses hydraulic damping and spring force to smoothly close the door and then provide a continuous bias force to hold the door closed.

If the user enables powered operation of the door by depressing a push plate, or the like as above described, the door will either open automatically (fully automatic mode), or will open slightly and wait for the user to push it open with reduced force requirement (power assist mode). If controller DIP switched 133 are configured for enablement of the push and go feature, then every time the door is pushed open slightly from the closed position it will either open automatically under power or it will provide power opening assistance depending on controller configuration.

As may be appreciated a versatile door operator is provided by this invention which is appropriate for use in entranceways accessible to persons of a variety of abilities.

What is claimed is:

1. An apparatus for controlling opening and closing of a door, comprising:

(A) a cylinder for guiding a piston linearly along an axis, said piston having a slot and a rack gear formed within said slot, and a pinion gear engages said rack-gear of said piston, said pinion gear being coupled to a connecting arm for moving the door;

(B) a spring that provides a door closing force, said door closing force urging said piston in a first direction along said axis, wherein said cylinder and said piston form a first fluid chamber, and said door closing force is dampened by a flow of fluid from said first fluid chamber; and (C) a rotatable drive screw that provides a door opening force, said door opening force urging said piston in a second direction along said axis, said second direction being opposite said first direction;

wherein said spring and said rotatable drive screw are positioned on opposite sides of said piston.

2. The apparatus of claim 1, further comprising a threaded nut for engaging said rotatable screw.

3. The apparatus of claim 2, further comprising a mechanical restraint for inhibiting rotation of said threaded nut.

4. The apparatus of claim 3, said piston having a first side disposed at a first position along said axis and a second side disposed at a second position along said axis, said first and second sides being on opposite ends of said piston, wherein said spring urges said piston in said first direction by supplying said door closing force to said first side of said piston, and said threaded nut urges said piston in a second direction by transferring said door opening force to said second side of said piston.

5. The apparatus of claim 4, wherein said first and second forces each have a force component aligned along said axis.

6. The apparatus of claim 5, wherein said spring and said rotatable drive screw are aligned along said axis.

7. The apparatus of claim 5, wherein said spring directly contacts said first side of said piston.

8. The apparatus of claim 7, further comprising a mechanical member, coupled to said threaded nut, for transferring said door opening force from said threaded nut to said second side of said piston.

9. The apparatus of claim 8, wherein said mechanical member is a shuttle having a semicircular cross-section.

10. The apparatus of claim 8, wherein said mechanical member contacts said second side of said piston.

11. The apparatus of claim 1, said cylinder and said piston forming a second fluid chamber, said first and second fluid chambers being disposed in said cylinder and separated by said piston, wherein said door opening force is dampened by fluid flow from said second fluid chamber to said first fluid chamber.

12. The apparatus of claim 1, further comprising a motor for turning said rotatable drive screw.

13. The apparatus of claim 12, further comprising a gear drive for mechanically coupling said motor to said rotatable drive screw.

14. The apparatus of claim 12, further comprising a controller, coupled to said motor, for controlling rotation of said rotatable drive screw.

15. The apparatus of claim 14, wherein said controller includes means for selecting a level of assistance during door opening ranging from reduction of user opening force required for door opening to elimination of said user opening force.

16. This apparatus of claim 14, wherein said controller includes means for selecting a level of resistance during door closing range from no resistance to a level sufficient to arrest door closing motion.

* * * * *